US007950095B2

(12) United States Patent
Honeycutt et al.

(10) Patent No.: US 7,950,095 B2
(45) Date of Patent: May 31, 2011

(54) GANGWAY AND METHOD FOR MANUFACTURING SAME

(75) Inventors: Robert W. Honeycutt, Pawleys Island, SC (US); Thomas A. Mefferd, Mt. Pleasant, SC (US)

(73) Assignee: Safe Rack LLC, Andrews, SC (US)

( * ) Notice: Subject to any disclaimer, the term of this patent is extended or adjusted under 35 U.S.C. 154(b) by 125 days.

(21) Appl. No.: 12/329,883

(22) Filed: Dec. 8, 2008

(65) Prior Publication Data

US 2009/0144916 A1 Jun. 11, 2009

Related U.S. Application Data

(60) Provisional application No. 61/012,458, filed on Dec. 9, 2007.

(51) Int. Cl.
*E04F 11/02* (2006.01)

(52) U.S. Cl. ..... 14/69.5; 182/2.1

(58) Field of Classification Search ..... 14/69.5; 182/2.1–2.2, 21

See application file for complete search history.

(56) References Cited

U.S. PATENT DOCUMENTS

| | | | | |
|---|---|---|---|---|
| 309,320 | A | 12/1884 | Stockbridge | |
| 540,192 | A | 5/1895 | Rosback | |
| 981,613 | A * | 1/1911 | Carter | 193/38 |
| 1,505,116 | A * | 8/1924 | Wiebe | 238/10 R |
| 1,815,048 | A * | 7/1931 | Harrington | 182/80 |
| 1,944,159 | A * | 1/1934 | Otterbein | 182/1 |
| 2,326,844 | A | 8/1943 | Ely | |
| 3,095,848 | A | 7/1963 | Adolph | |
| 3,869,109 | A | 3/1975 | Russo | |
| 4,072,294 | A | 2/1978 | Densen | |
| 4,133,283 | A | 1/1979 | Ryan | |
| 4,154,318 | A | 5/1979 | Malleone | |
| 4,161,795 | A | 7/1979 | Quest | |
| 4,168,764 | A | 9/1979 | Walters | |
| 4,280,243 | A | 7/1981 | Durrant | |
| 4,335,803 | A | 6/1982 | Sugito | |
| 4,712,264 | A * | 12/1987 | Voith | 14/69.5 |
| 4,768,497 | A * | 9/1988 | Winge | 601/26 |
| 4,838,735 | A | 6/1989 | Warner | |
| 5,010,614 | A * | 4/1991 | Braemert et al. | 14/71.1 |

(Continued)

FOREIGN PATENT DOCUMENTS

GB 2275632 9/1994

OTHER PUBLICATIONS

International Search Report & Written Opinion issued on Feb. 6, 2009 by the International Searching Authority for copending international application No. PCT/US 08/85922.

PCT International Search Report and Written Opinion of the International Searching Authority dated Feb. 6, 2009 for PCT/US2008/85922 filed on Dec. 8, 2008, corresponding to co-pending U.S. Appl. No. 12/329,883.

(Continued)

*Primary Examiner* — Raymond W Addie

(74) *Attorney, Agent, or Firm* — Nelson Mullins Riley & Scarborough LLP

(57) ABSTRACT

A gangway comprises at least one component formed from a continuous piece of metal. The at least one component formed from the continuous piece of metal may be a support structure or an underbody, a platform, a ramp, a step, or other support surface. A method for manufacturing such a gangway comprises forming the at least one component from the continuous piece of metal.

37 Claims, 33 Drawing Sheets

U.S. PATENT DOCUMENTS

| | | | | |
|---|---|---|---|---|
| 5,077,852 | A * | 1/1992 | Karlsson | 14/69.5 |
| 5,097,787 | A | 3/1992 | Bruce | |
| 5,319,818 | A * | 6/1994 | Baranowski | 14/71.1 |
| 5,402,546 | A * | 4/1995 | Baranowski | 14/69.5 |
| 5,794,292 | A | 8/1998 | Ricci, Jr. | |
| 5,950,266 | A | 9/1999 | Streeter et al. | |
| 5,994,667 | A | 11/1999 | Merdan et al. | |
| 6,425,572 | B1 * | 7/2002 | Lehr | 256/1 |
| 6,526,614 | B2 | 3/2003 | Anderson et al. | |
| 6,813,792 | B2 | 11/2004 | Miller | |
| 6,923,140 | B1 | 8/2005 | Cook | |
| 7,159,261 | B2 | 1/2007 | Carrigan | |
| 7,383,600 | B2 | 6/2008 | Carrigan | |
| 2002/0189177 | A1 * | 12/2002 | Eve et al. | 52/184 |
| 2004/0107519 | A1 | 6/2004 | Grody | |
| 2007/0161460 | A1 * | 7/2007 | Katz et al. | 482/35 |
| 2010/0031455 | A1 | 2/2010 | Honeycutt | |
| 2010/0031456 | A1 | 2/2010 | Honeycutt | |
| 2010/0032633 | A1 | 2/2010 | Honeycutt | |

OTHER PUBLICATIONS

PCT International Search Report and Written Opinion of the International Searching Authority dated Sep. 24, 2009 for PCT/US2009/053285 filed on Aug. 10, 2009, corresponding to co-pending U.S. Appl. No. 12/468,704.

PCT International Search Report and Written Opinion of the International Searching Authority dated Sep. 24, 2009 for PCT/US2009/053299 filed on Aug. 10, 2009, corresponding to co-pending U.S. Appl. No. 12/487,408.

PCT International Search Report and Written Opinion of the International Searching Authority dated Sep. 28, 2009 for PCT/US2009/053313 filed on Aug. 10, 2009, corresponding to co-pending U.S. Appl. No. 12/537,842.

Office Action issued by the U.S. Patent and Trademark Office on Oct. 4, 2010 for copending U.S. Appl. No. 12/487,408.

* cited by examiner

GANGWAY AND METHOD FOR MANUFACTURING SAME

CLAIM OF PRIORITY

The present application claims the benefit of the U.S. provisional application filed on Dec. 9, 2007 by Honeycutt et al. for A GANGWAY (Ser. No. 61/012,458), the entire disclosure of which is incorporated by reference as if set forth verbatim herein.

FIELD OF THE INVENTION

The present invention relates generally to gangways, and more particularly, to gangways that provide access to the top of a storage container or the like.

BACKGROUND OF THE INVENTION

Gangways may be comprised of platforms, ramps, bridges, steps, guardrails, and other support structures and are used to provide access to an area, such as the top of a storage container. For example, a semi-trailer truck or a railroad carriage transporting dry goods may need to be unloaded from the container's top. A gangway is used to provide workers a path to unload the material. The major parts of current gangways are constructed by a process involving cutting and welding a large number of smaller components together.

SUMMARY OF THE INVENTION

The present invention recognizes and addresses the foregoing considerations, and others, of prior art construction and methods.

In this regard, one aspect of the invention provides a gangway for providing access to a storage container from above, the gangway comprising a support structure comprising a left side support and a right side support, a top support pivotally interconnected between the left and right side supports such that the left and ride side supports pivot relative to the top support, and a base support pivotally interconnected between the left and right side supports such that the base support pivots relative to the left and right side supports such that the base support remains generally parallel to the ground as the base support pivots relative to the left and right side supports, and the base support is formed from a first continuous piece of metal.

According to another aspect, the present invention also provides a gangway comprising a support platform, a support structure pivotally connected to the support platform, and a ramp connected to the support structure, where the ramp is formed from a first continuous piece of metal.

A further aspect of the present invention provides a gangway comprising a support platform, a support structure pivotally connected to the support platform, a first ramp connected to the support structure, and a telescoping second ramp slideably located between the first ramp and the support structure, wherein the second ramp is formed from a first continuous piece of metal.

Yet a further aspect of the present invention provides a gangway comprising components formed from continuous pieces of metal in order to eliminate welds in areas of high load concentration or to replace welded areas of high load concentration with areas formed from a continuous piece of metal or from folds in a continuous piece of metal.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
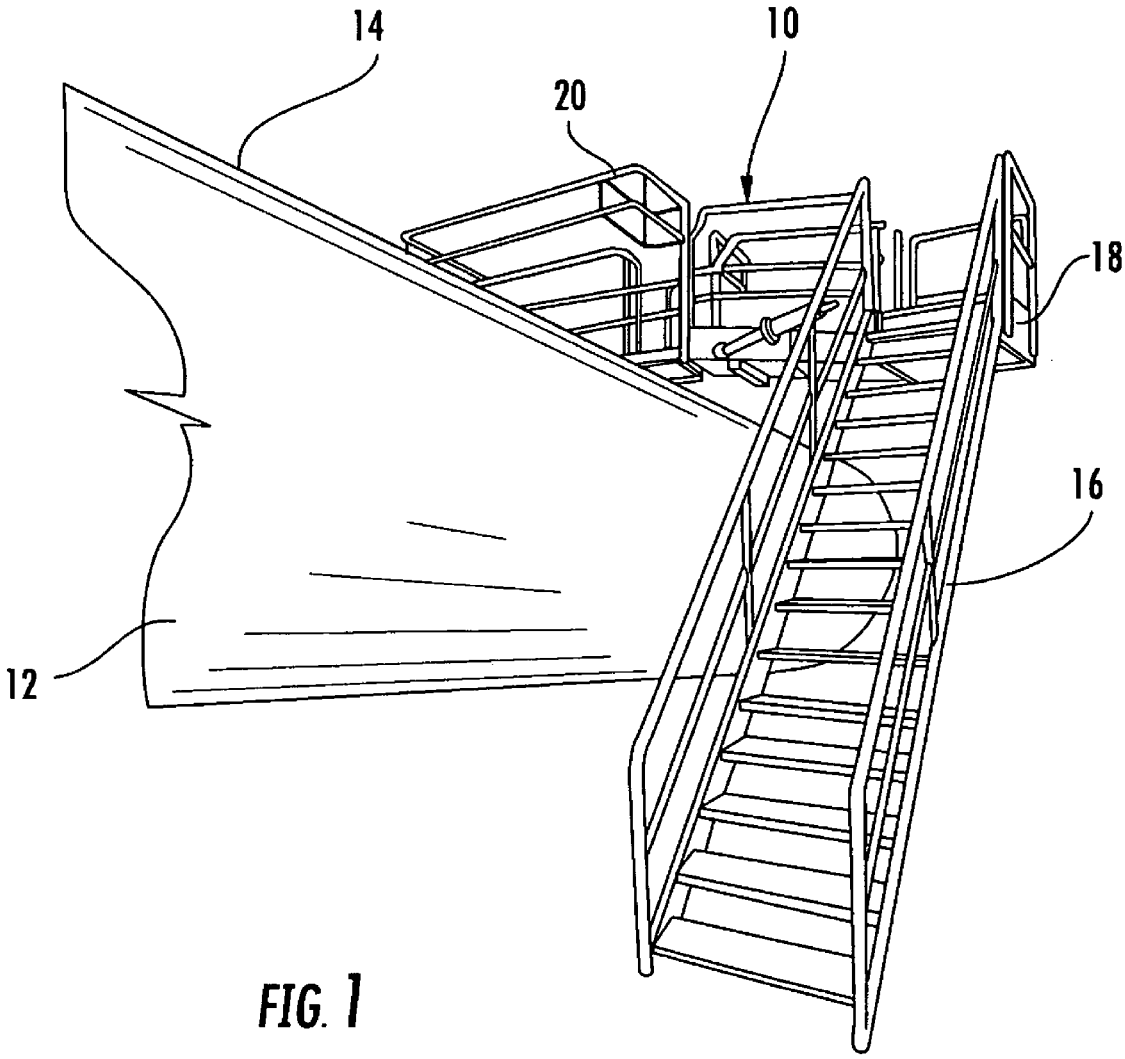
FIG. 1 is a perspective view of a gangway in use in accordance with one embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

FIG. 1 illustrates the placement of a gangway 10 to provide access to a storage container 12 from above. Storage container 12 typically contains material, such as particulate matter, to be unloaded from the container's top indicated at 14. A nearby stairwell 16 provides access to platform 18, to which gangway 10 is attached. A user may access top 14 of container 12 via stairwell 16, platform 18, and gangway 10. An optional safety cage 20 attached to gangway 10 may be used with any of the gangways described below.

Figure 2:
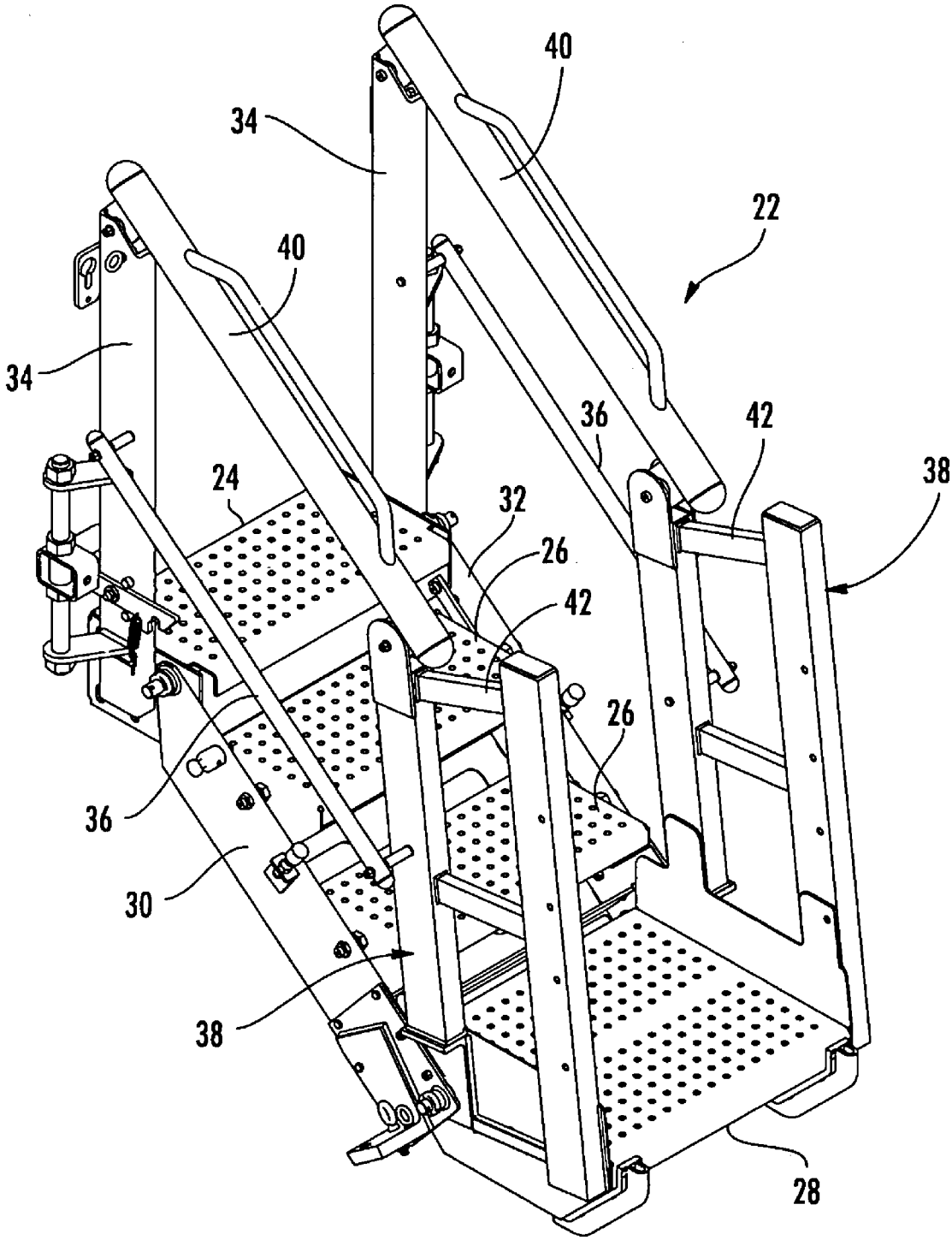
FIG. 2 is a perspective view of a gangway in accordance with another embodiment of the present invention.

FIG. 2 illustrates a gangway 22 in accordance with an embodiment of the present invention. As shown, gangway 22 includes a top support 24 (or "base tread"), one or more intermediary supports (or "stair treads") 26, and a base support 28 (or "seatainer tread"). Each support 24, 26, and 28 is pivotally connected to a left side support 30 and a right side support 32 of a support structure (or "underbody" or "u-body"). An exemplary support structure is described in more detail below with respect to FIGS. 20A through 20D. Generally, top support 24 is connected to a fixed structure such as platform 18 or stairwell 16 illustrated in FIG. 1. It should be understood that additional intermediary supports 26 may be included depending on the desired configuration and size of gangway 22.

Gangway 22 includes several other support structures, such as guardrails 34 and 38, midrails 36, and handrails 40 and 42, that should be understood by those of ordinary skill in the relevant art. In the present embodiment, tread supports 24, 26, and 28 are pivotally attached to side supports 30 and 32 by structures that allow the tread supports to pivot with respect to supports 30 and 32, such as a combination of rivets, rods, and/or bushings, although any suitable structure may be used. In another embodiment, supports 24, 26, and 28 may be connected to side supports 30 and 32 so that the supports are unable to rotate with respect to the side supports. In another embodiment, two counterbalanced springs are connected to guardrails 34 and 38 on each side of gangway 22 or to supports 30 and 32. Heavy-duty chains may be connected to gangway 22 and specifically to rails 34 and 38.

In operation, the support structure pivots relative to top support 24 so that gangway 22 may be raised or lowered in order to position base support 28 adjacent to the relevant container. Intermediary supports 26 and base support 28 pivot relative to side supports 30 and 32 of the support structure such that the intermediary and base supports remain generally parallel to the ground or to the surface of the relevant container. In this manner, side supports 30 and 32 may be rotated such that gangway 22 retracts into a generally vertical position. Counterbalanced springs connected to gangway 22 allow the gangway to be easily rotated up and down. Chains connected to gangway 22 may be used to secure the gangway into a specific orientation.

Figure 3:
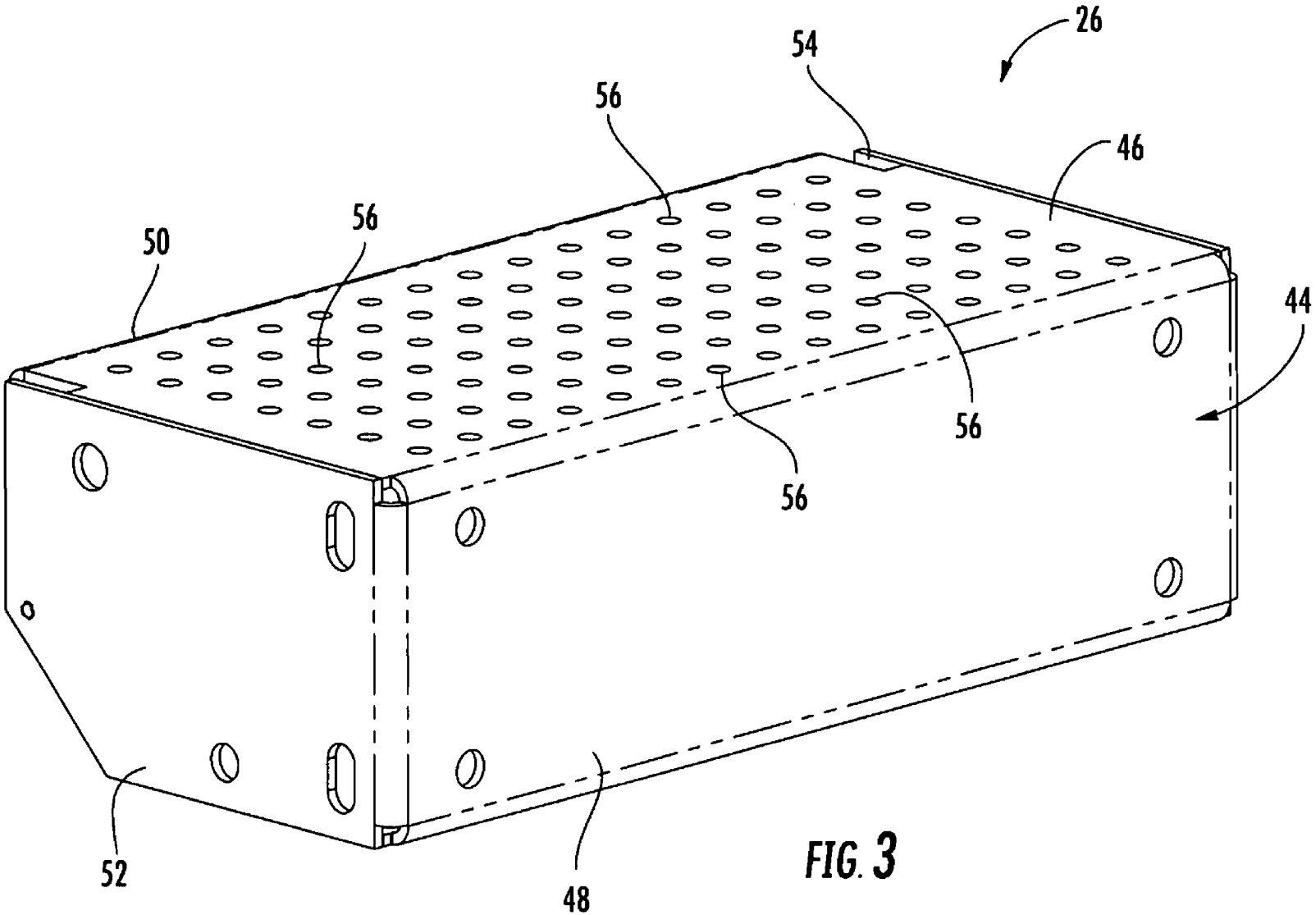
FIG. 3 is a perspective view of a support of the gangway of FIG. 2.

FIGS. 3 through 5C illustrate intermediary support 26 of gangway 22 (FIG. 2) set forth above. Referring to FIG. 3, intermediary support 26 is preferably formed from a continuous piece 44 of metal and comprises a generally planar support surface 46, a front surface 48, a relatively small back surface 50, and two side surfaces 52 and 54.

As used herein, a continuous piece of metal is one for which the parts have not been welded together or otherwise connected but comes from an integral, unbroken piece of metal, such as sheet metal. Accordingly areas that consisted of separate pieces of metal welded together, including high load concentration areas, in prior configurations are replaced by areas of continuous pieces of metal or folds in continuous pieces of metal. The continuous pieces of metal described herein may be formed, cut, or "butterflied" from a piece of sheet metal. These continuous pieces of sheet metal may be various types of metal, such as aluminum or steel, and can vary in thickness. The components described herein are formed from sheet metal having a thickness within the range of approximately 0.048 inches to 0.250 inches. Generally, sheet metal having a thickness of approximately 0.060 inches and greater is used when the sheet metal is made from steel and approximately 0.090 inches, 0.120 inches, and greater when made from aluminum. It should be understood that the thickness of the piece of sheet metal used to form the components described below will vary depending on the type of metal used and the size of the desired component. That is, a relatively large platform may be formed from aluminum sheet metal having a thickness of 0.120 inches, while a relatively small step may be formed from steel sheet metal having a thickness of 0.048 inches.

As shown most clearly in FIG. 3, a number of apertures (denoted at 56) may be defined in support surface 46 to provide traction when the surface is walked on, which may be referred to as the "tread" area. In another embodiment, support 26 may be formed such that the perimeters of apertures 56 are raised to provide additional traction. While apertures 56 as shown in FIG. 3 are circular, it should be understood that other shapes may be employed without departing from the scope and spirit of the present invention.

Figure 4A:
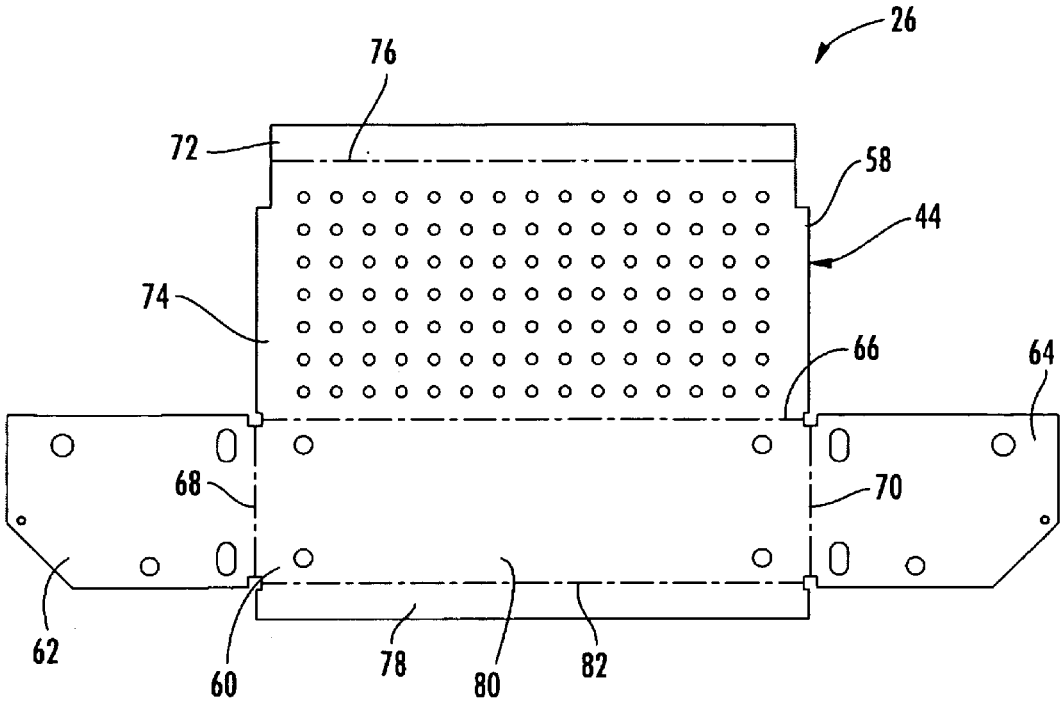
FIGS. 4A through 4D show successive steps in forming the support of FIG. 3.

FIG. 4A illustrates continuous piece 44 of metal prior to folding to form intermediary support 26. As can be seen, piece 44 includes a first generally rectangular area 58, a second generally rectangular area 60, and two flanges 62 and 64 separated by area 60. As a result, a fold line 66 is defined between areas 58 and 60, and fold lines 68 and 70 are defined between area 60 and flanges 62 and 64, respectively. A second portion 72 of area 58 is separated from a first portion 74 of area 58 by fold line 76. Likewise, a second portion 78 of area 60 is separated from a first portion 80 of area 60 by fold line 82. As one skilled in the art will recognize, the "fold lines" may simply represent an imaginary line between two points about which folding occurs rather than a groove or other physical demarcation.

Figure 4B:
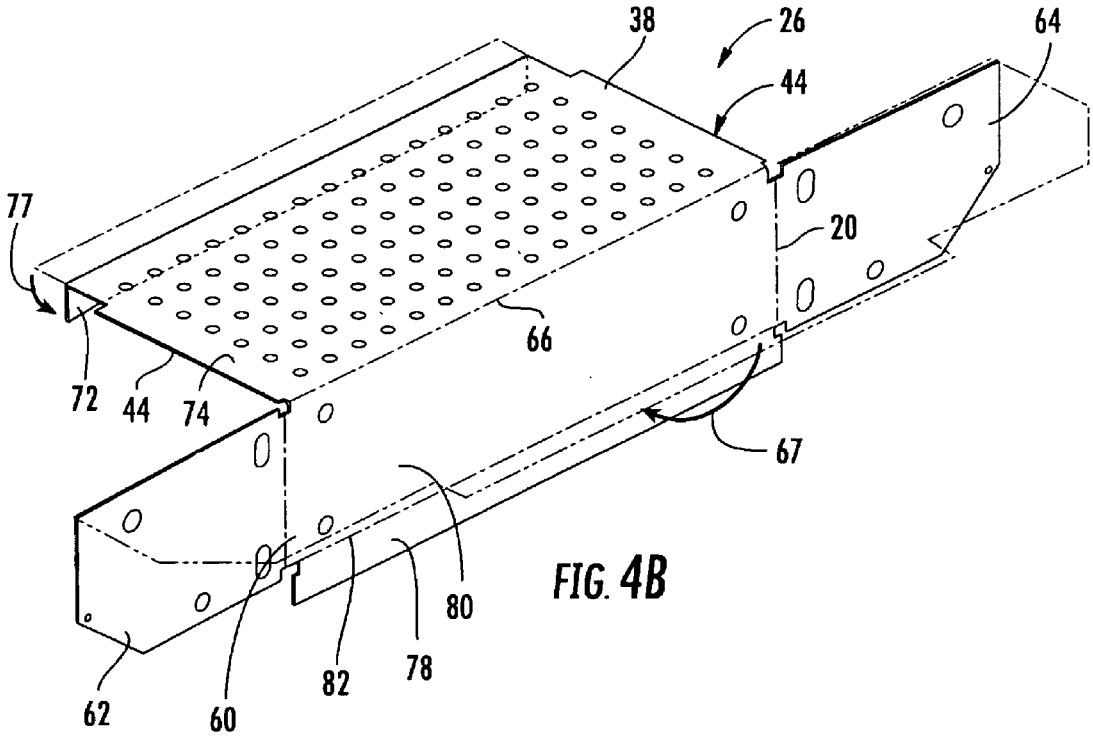
Figure 4C:
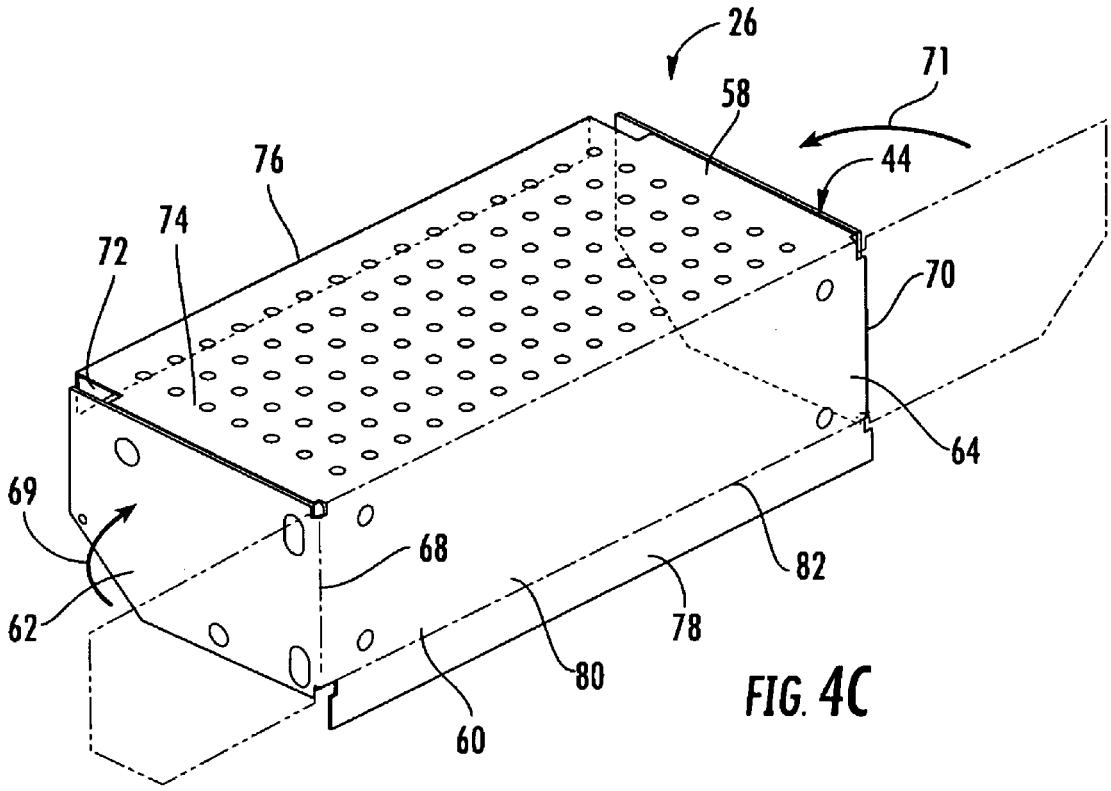
Figure 4D:
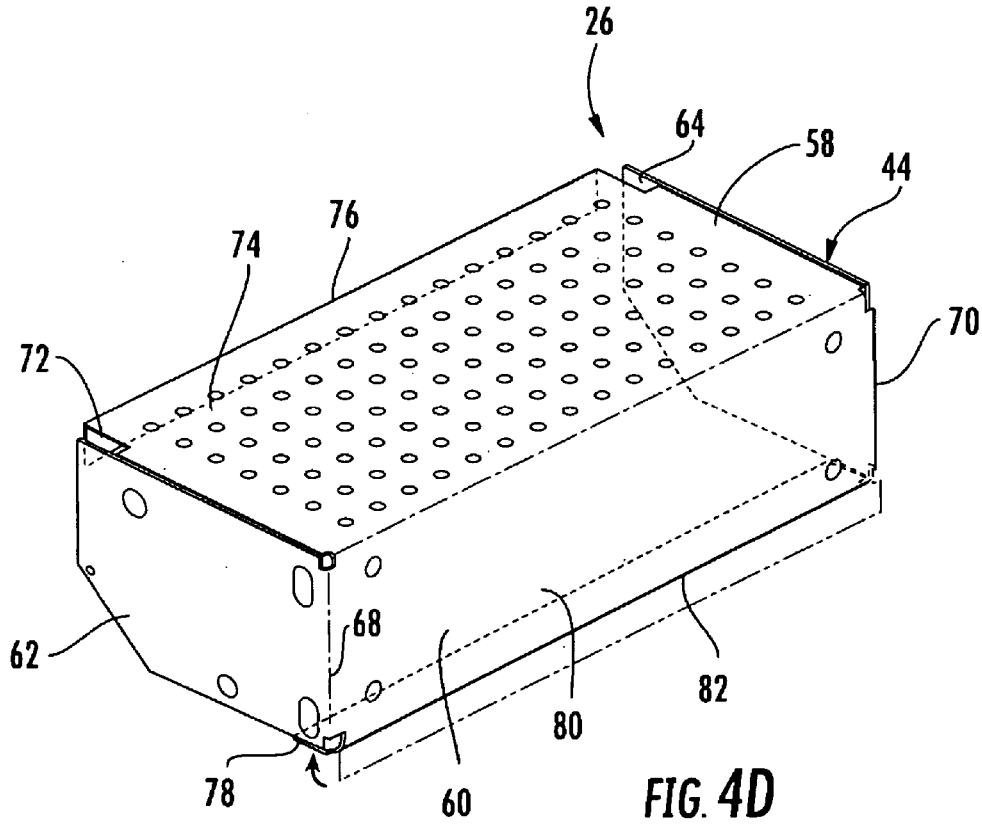

Referring to FIGS. 4B through 4D, intermediary support 26 is formed by folding continuous piece 44 of metal at fold lines 66 and 76 (indicated by arrows 67 and 77) as shown in FIG. 4B. As shown in FIG. 4C, flanges 62 and 64 are folded along respective fold lines 68 and 70 (indicated by arrows 69 and 71). As shown in FIG. 4D, second portion 78 is folded along fold line 82. It should be understood that adjacent pieces of support 26 or their respective edges may be welded together after folding for additional support. For example, the edges of area 58 may be welded to the adjacent edges of flanges 62 and 64.

Figure 5A:
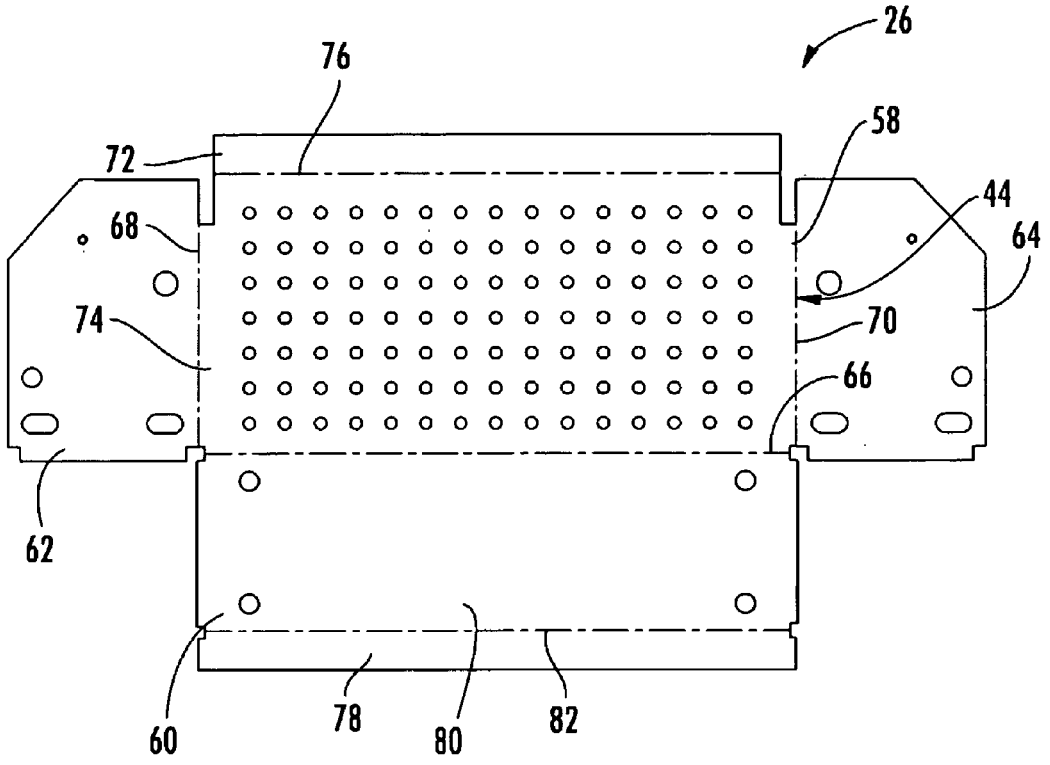
FIGS. 5A through 5D show successive steps in forming the support of FIG. 3 in accordance with another embodiment of the present invention.

FIG. 5A illustrates continuous piece 44 of metal prior to folding to form intermediary support 26 in accordance with another embodiment of the present invention. As can be seen, piece 44 includes a first generally rectangular area 58, a second generally rectangular area 60, and two flanges 62 and 64 separated by area 58. As a result, a fold line 66 is defined between areas 58 and 60, and fold lines 68 and 70 are defined between area 58 and flanges 62 and 64, respectively. A second portion 72 of area 58 is separated from a first portion 74 of area 58 by fold line 76. Likewise, a second portion 78 of area 60 is separated from a first portion 80 of area 60 by fold line 82. As one skilled in the art will recognize, the "fold lines" may simply represent an imaginary line between two points about which folding occurs rather than a grove or other physical demarcation.

Figure 5B:
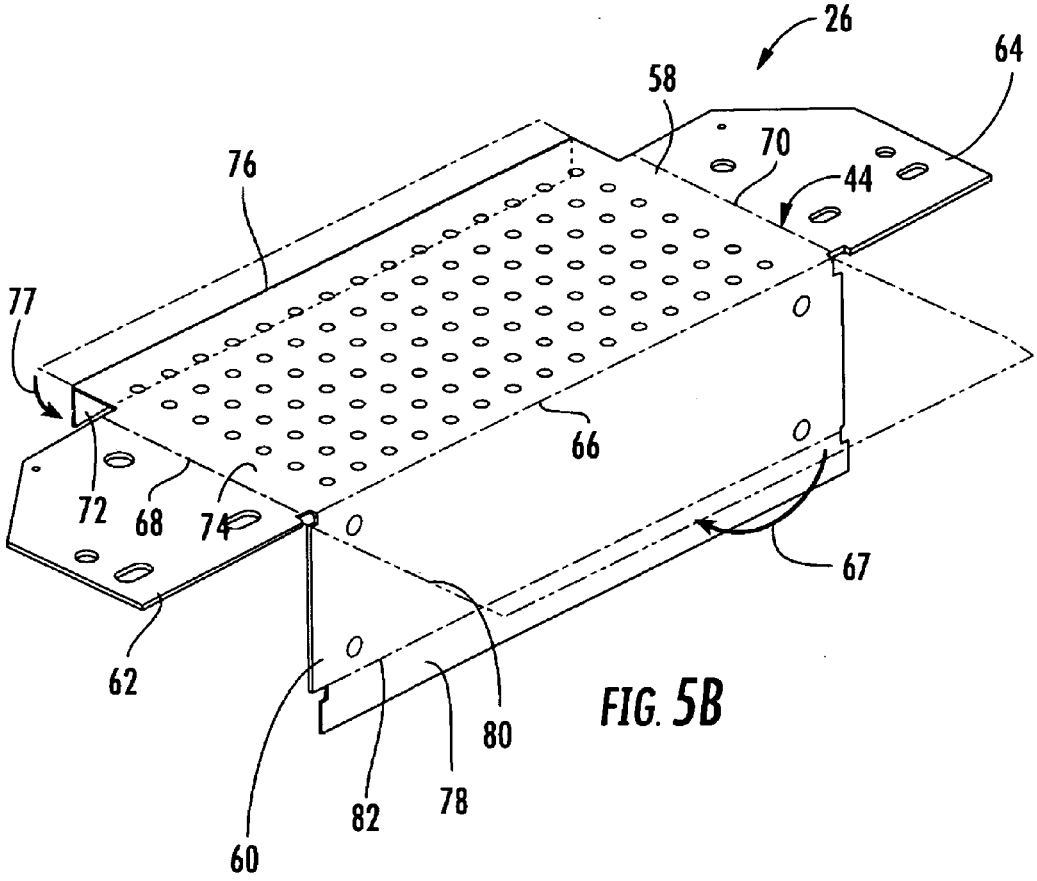
Figure 5C:
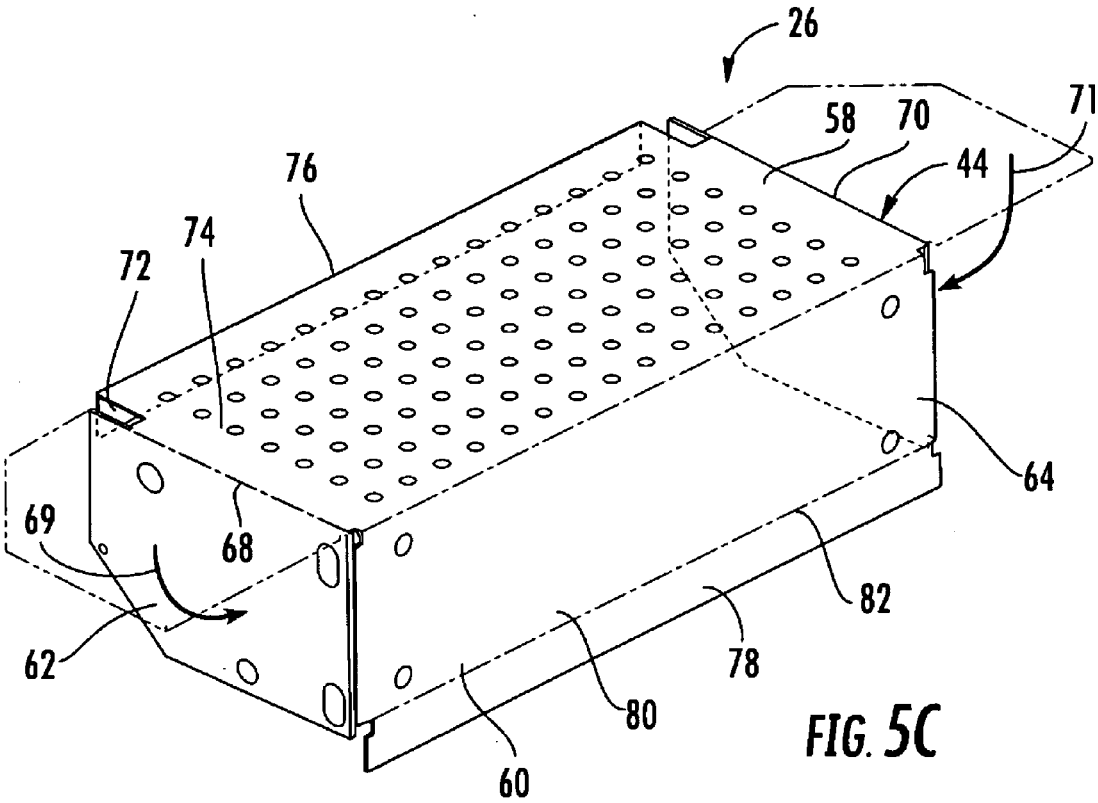
Figure 5D:
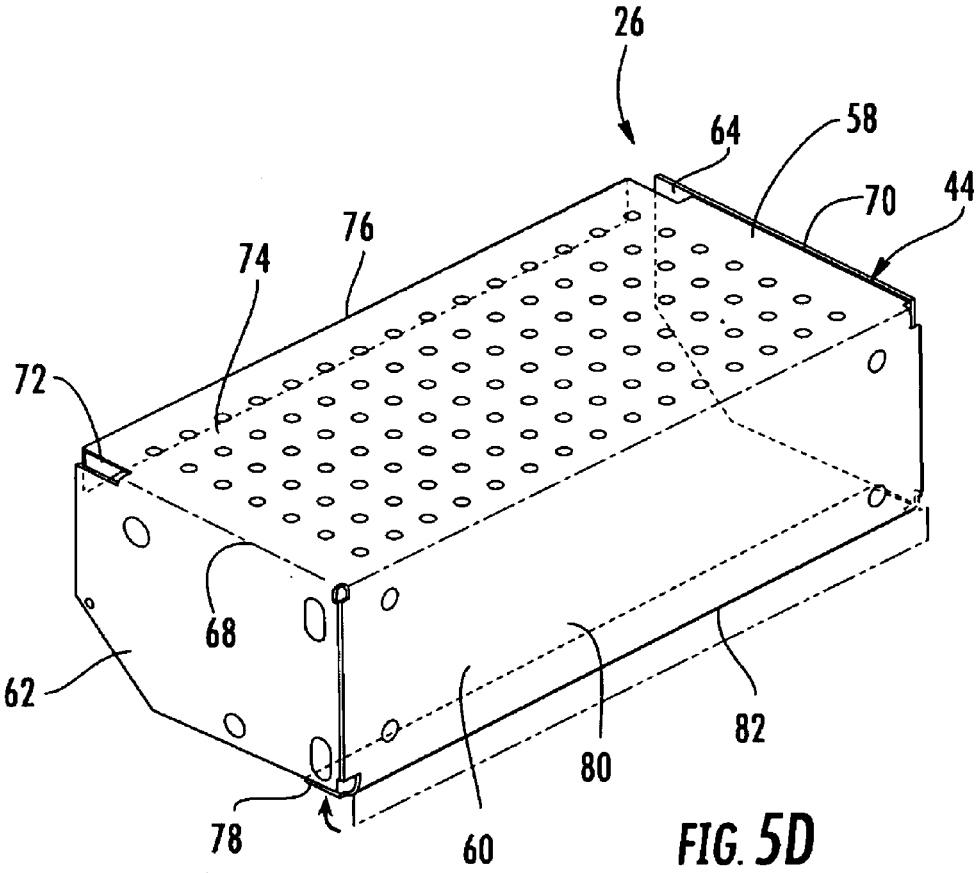

Referring to FIGS. 5B through 5D, intermediary support 26 is formed by folding continuous piece 44 of metal at fold lines 66 and 76 (indicated by arrows 67 and 77) as shown in FIG. 5B. As shown in FIG. 5C, flanges 62 and 64 are folded along respective fold lines 68 and 70 (indicated by arrows 69 and 71). As shown in FIG. 5D, second portion 78 is folded along fold line 82. It should be understood that adjacent pieces of support 26 or their respective edges may be welded together after folding for additional support. For example, the edges of area 60 may be welded to the adjacent edges of flanges 62 and 64.

Figure 6A:
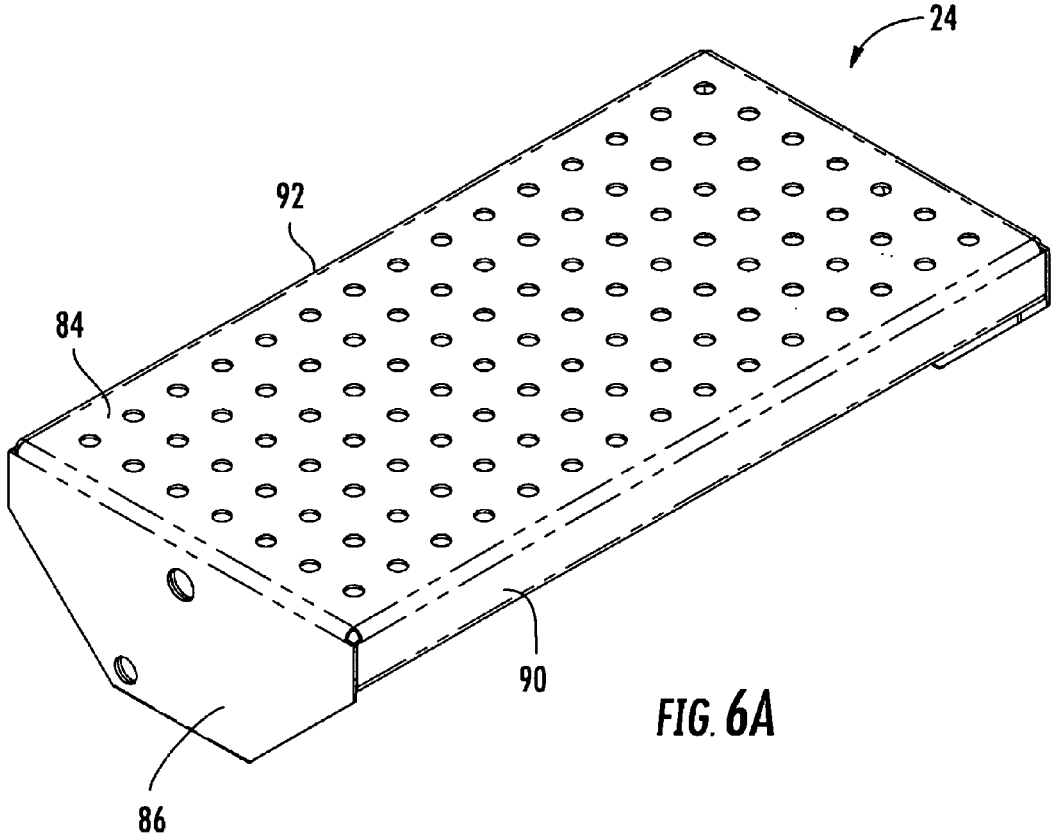
FIGS. 6A and 6B are perspective top and bottom views of another support of the gangway of FIG. 2.
Figure 6B:
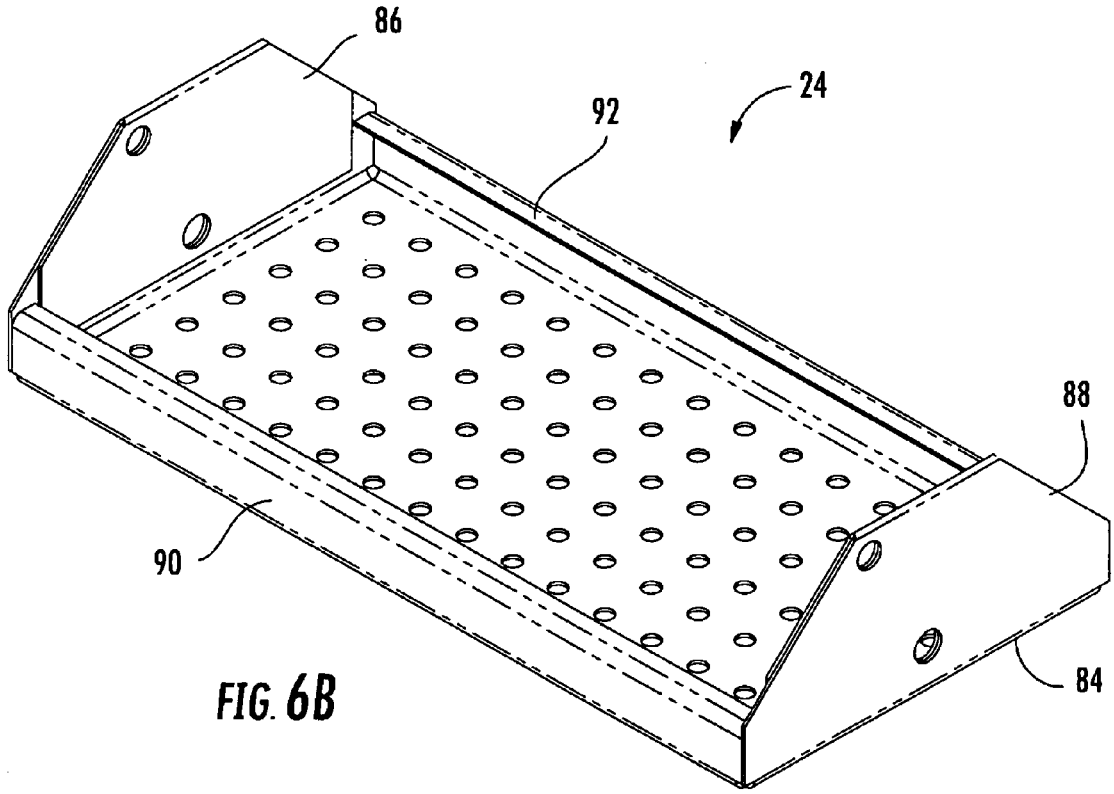

FIGS. 6A and 6B illustrate top support 24 of gangway 22 set forth above. Referring to FIGS. 6A and 6B, support 24 comprises a generally planar top surface 84 (or "tread" area), two generally trapezoidal sides 86 and 88, and two elongated sides 90 and 92.

Figure 7A:
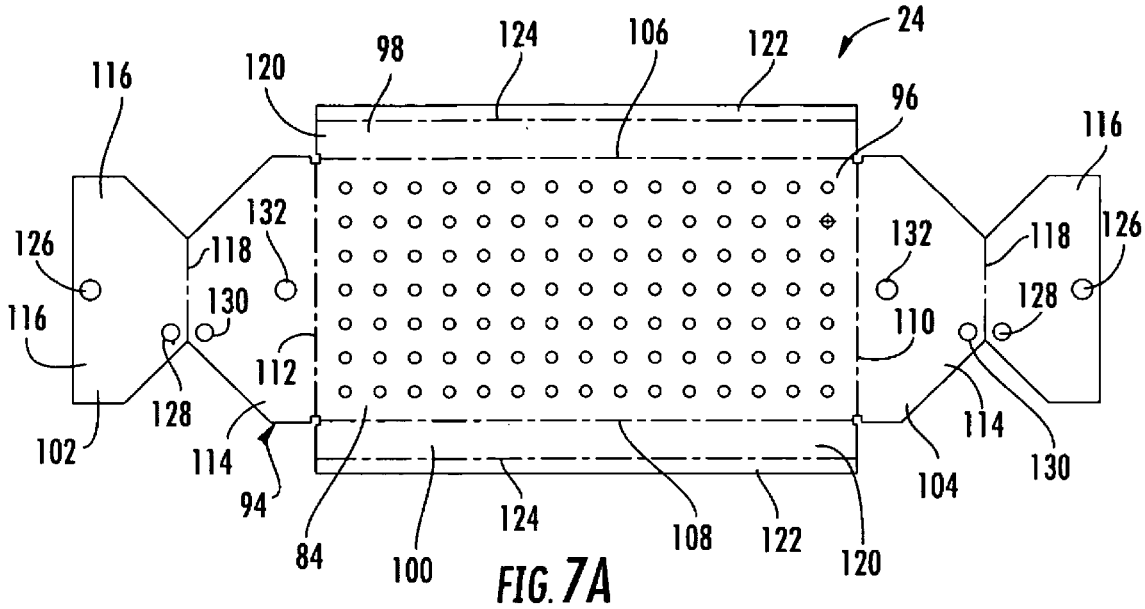
FIGS. 7A through 7D show successive steps in forming the support of FIGS. 6A and 6B.

Referring to FIG. 7A, top support 24 is preferably formed from a continuous piece 94 of metal. Piece 94 comprises three generally rectangular areas 96, 98, and 100, and flanges 102 and 104. Area 96, along with areas 98 and 100 and flanges 102 and 104, define respective fold lines 106, 108, 110, and 112. A first portion 114 of each flange 102 and 104 is apportioned from a second portion 116 of each flange by a fold line 118. Likewise, a first portion 120 of each of areas 98 and 100 is apportioned from a second portion 122 of each area by a respective fold line 124. Apertures 126 and 128 are defined by first portion 114 of flanges 102 and 104, and apertures 130 and 132 are defined by second portion 116 of the flanges.

Figure 7B:
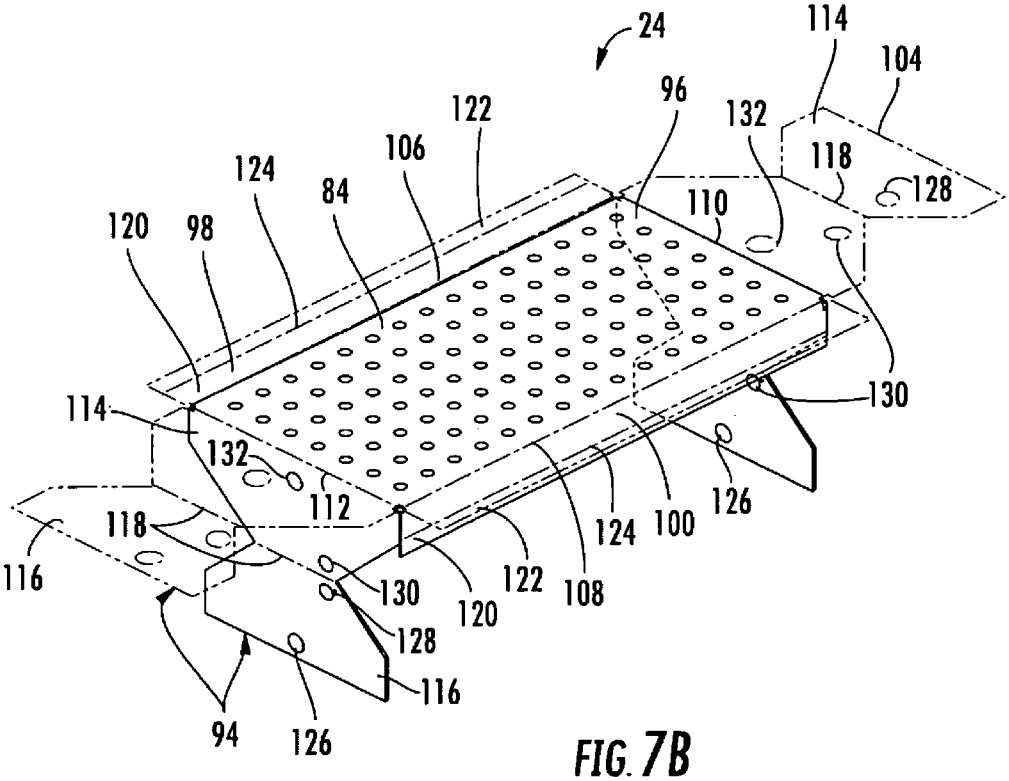
Figure 7C:
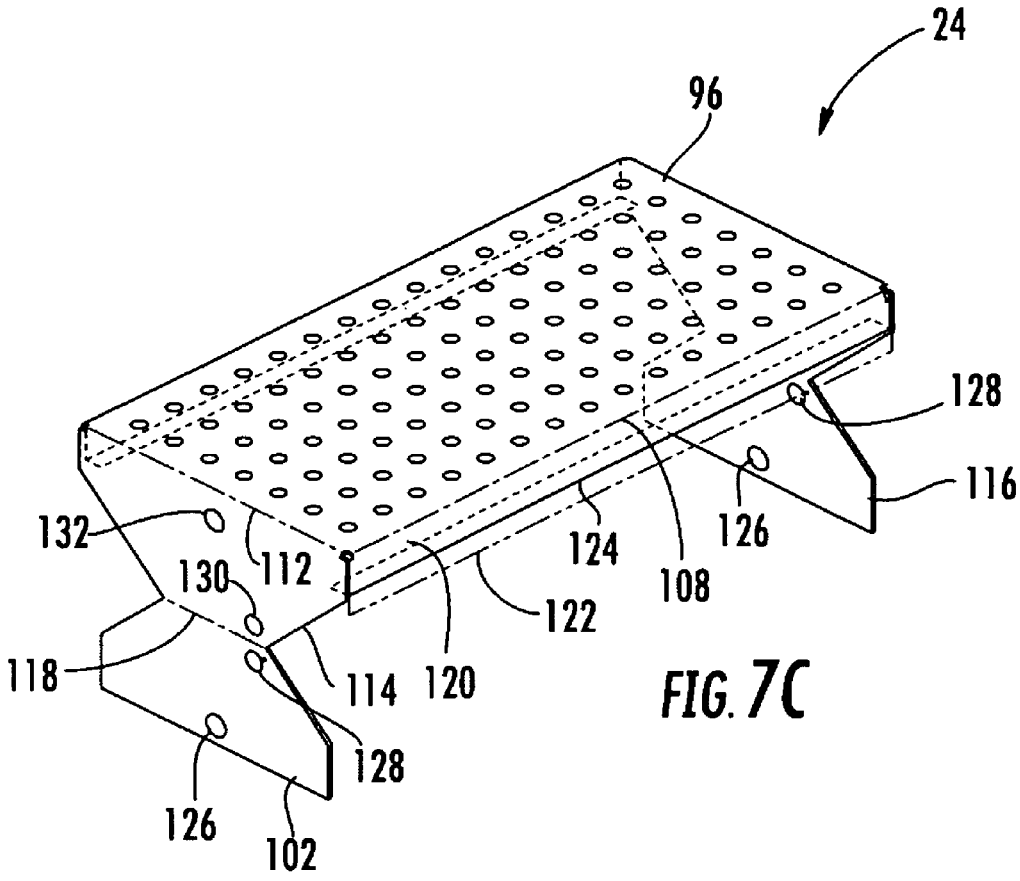
Figure 7D:
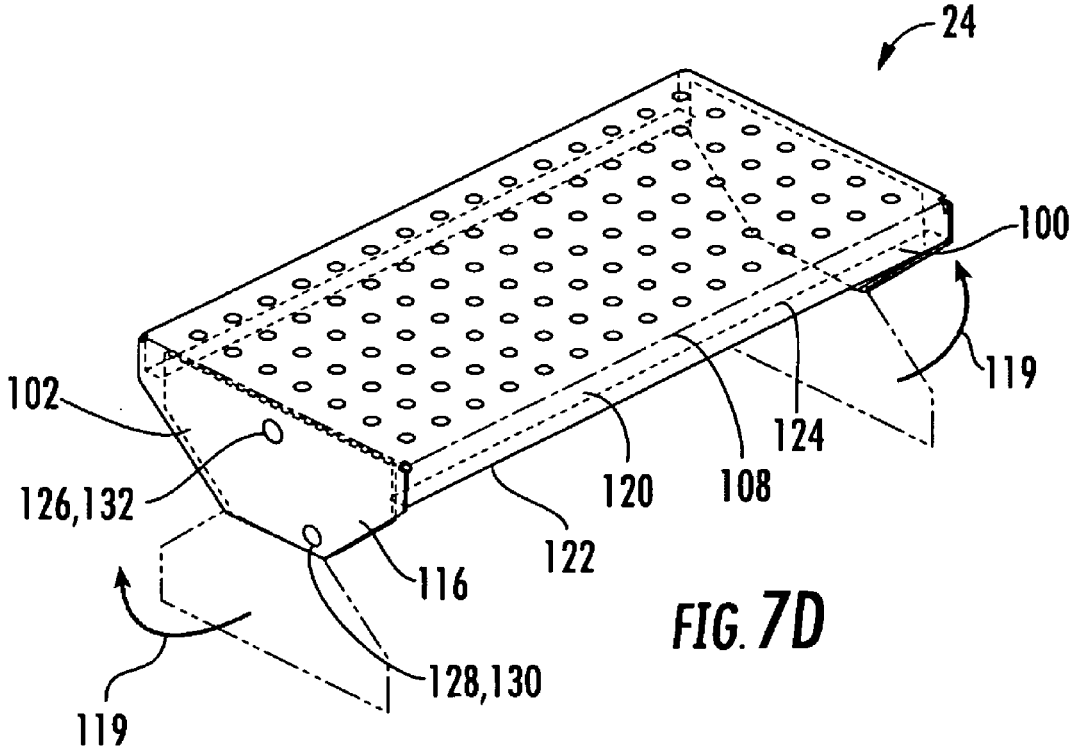

Referring to FIGS. 7B through 7D, top support 24 is formed by folding continuous piece of metal 94 at fold lines 106, 108, 110, and 112 as shown in FIG. 7B. Second portions 122 of areas 98 and 100 are angled toward the underneath of support surface 84 as shown in FIG. 7C, and second portions 116 of flanges 102 and 104 are back-folded along fold lines 118 (indicated by arrows 119) as shown in FIG. 7D such that the second portions overlay first portions 114 of the flanges and so that apertures 126 and 132 and apertures 128 and 130 coalign, respectively. Top structure 24 is pivotally connected to the support structure by fasteners, such as rivets, bolts, bearings, and/or bushings (see FIG. 2). A bar or rod may be passed through apertures 126, 132, 128, and 130 and attached to the fasteners or to side supports 30 and 32 for improved stability.

Figure 8A:
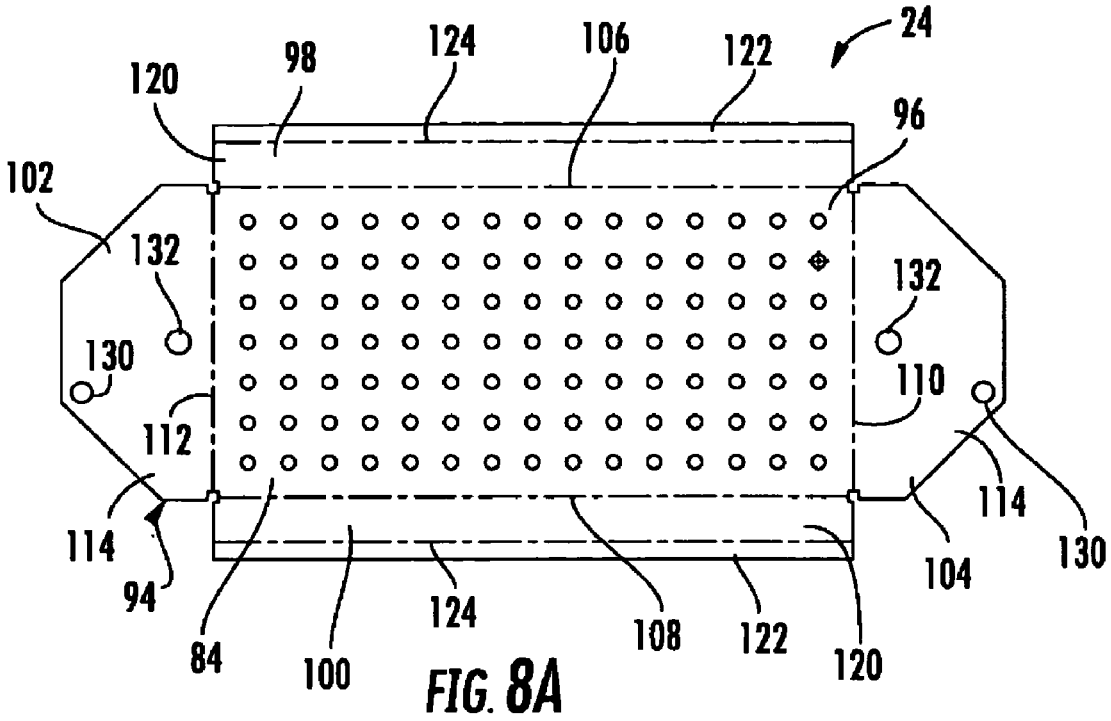
FIGS. 8A through 8C show successive steps in forming the support of FIGS. 6A and 6B in accordance with another embodiment of the present invention.
Figure 8B:
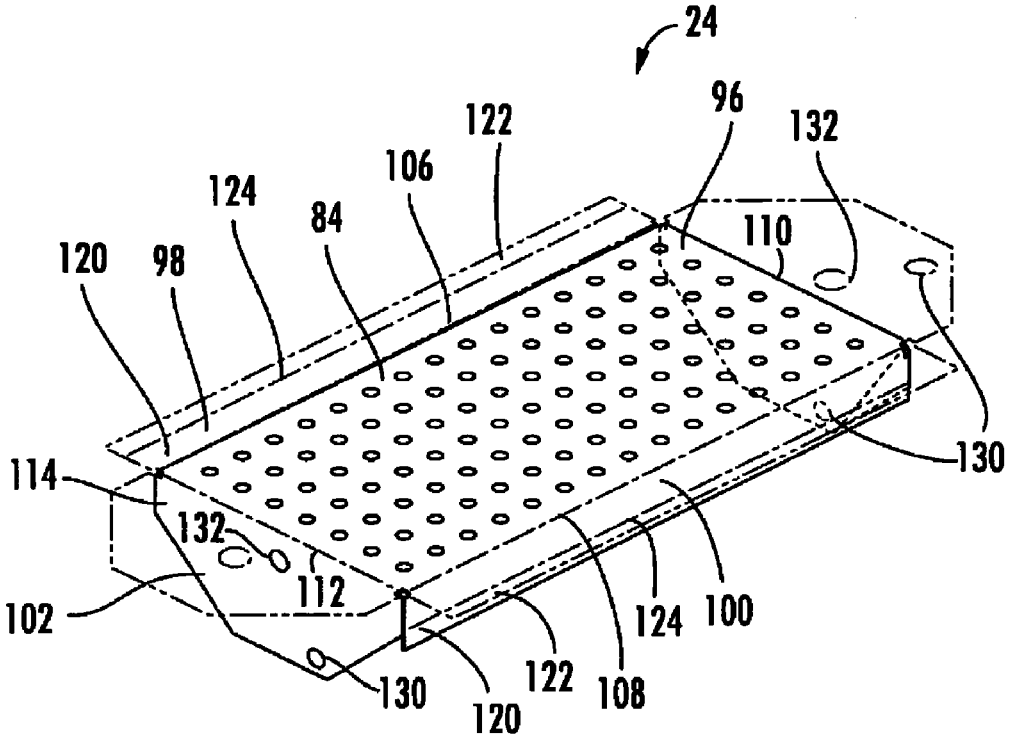
Figure 8C:
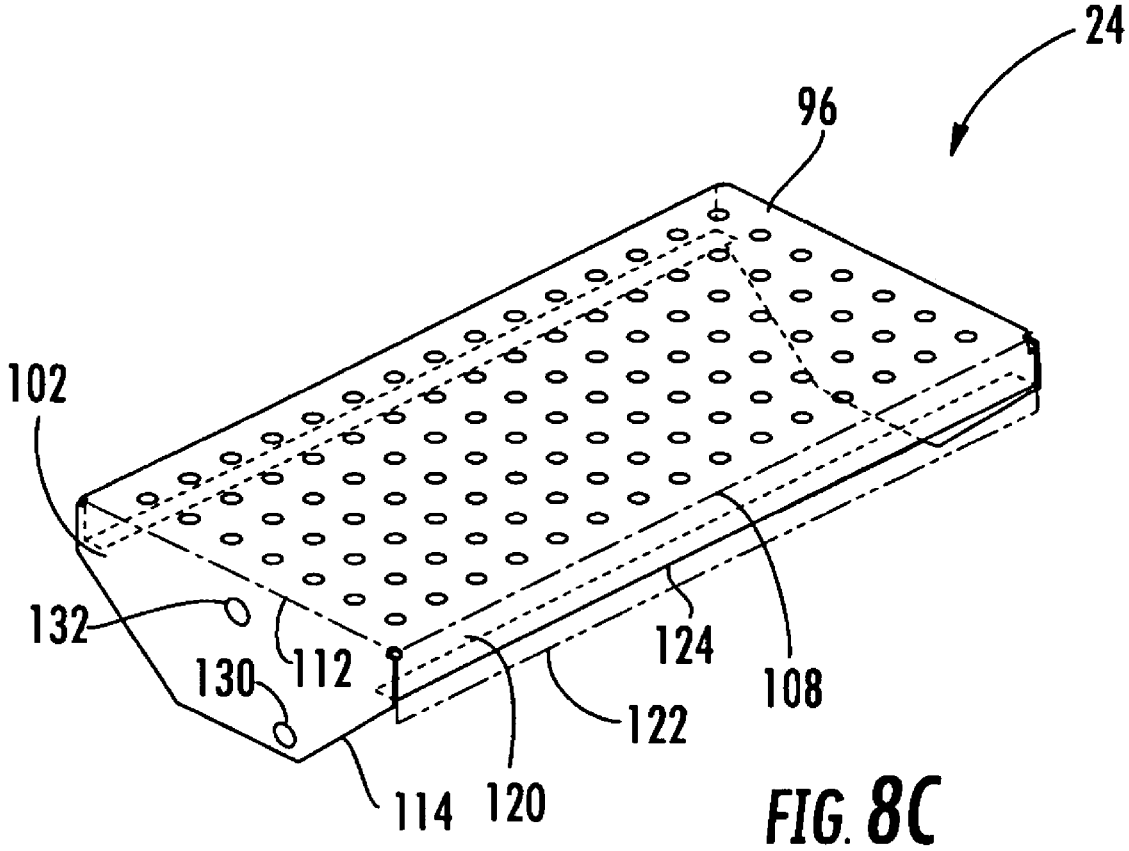

In another embodiment illustrated in FIGS. 8A through 8C, top support 24 is formed from a continuous piece 94 of metal in a manner similar to that described above with respect to FIGS. 7A through 7D. In this embodiment, second portions 116 of flanges 102 and 104 have been removed. As shown in FIGS. 8A through 8C, top support 24 is otherwise formed from continuous piece 94 of metal in a manner identical to that described above.

Figure 9:
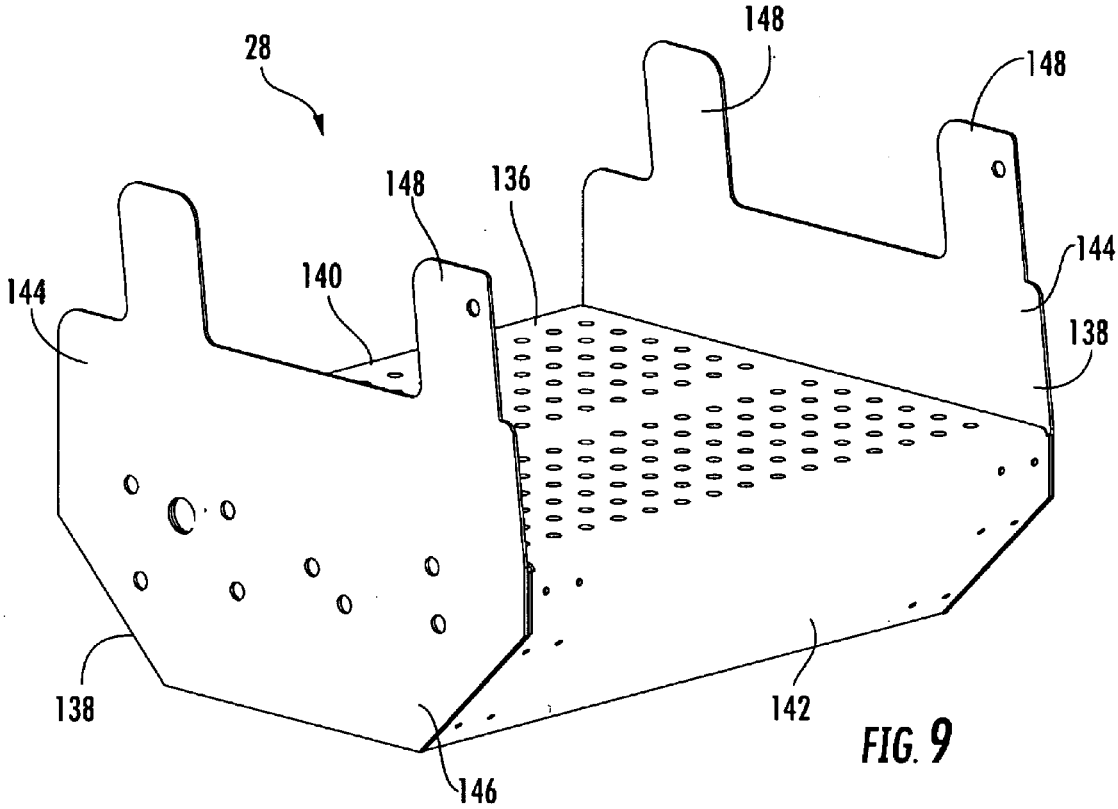
FIGS. 9 and 10 are perspective top and bottom views of another support of the gangway of FIG. 2.
Figure 10:
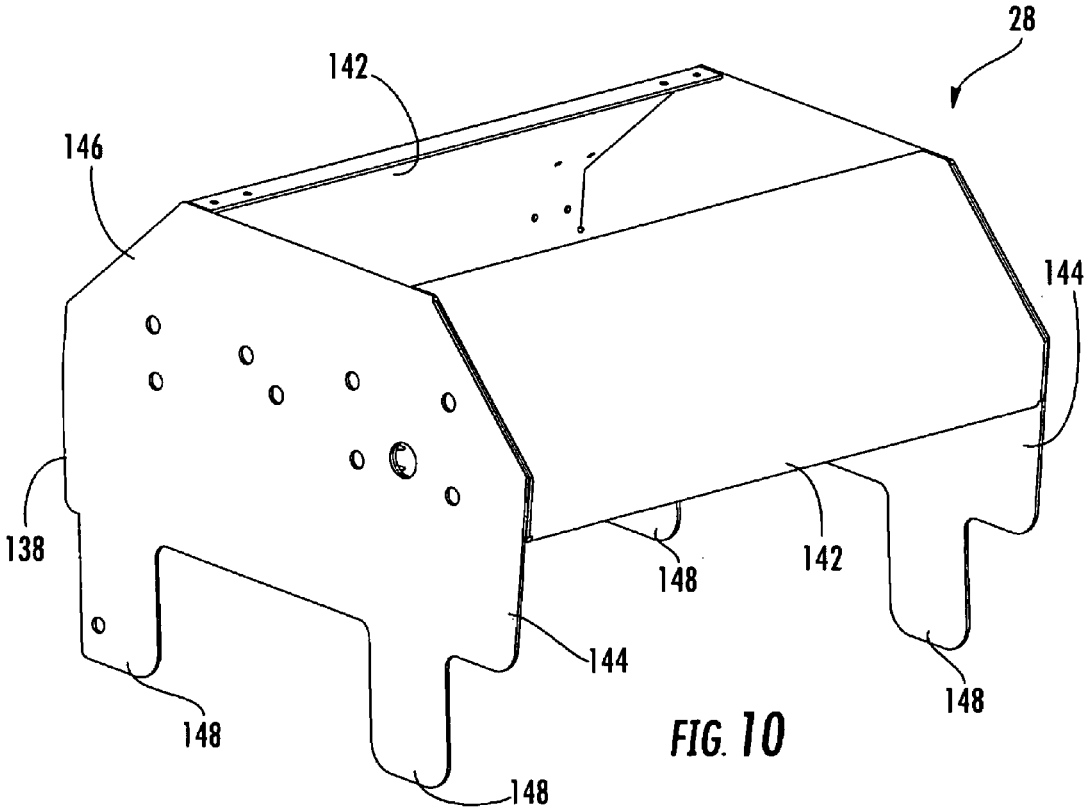

FIGS. 9 through 12C illustrate base support 28 of gangway 22 set forth above. Referring to FIGS. 9 and 10, support 28 comprises a support surface 136 and two generally planar sides (commonly denoted at 138). Support surface 136 comprises a generally planar portion 140 terminating in two angled sides (commonly denoted at 142). Each planar side 138 comprises a generally rectangular area 144, a generally trapezoidal area 146, and extensions 148.

Figure 11:
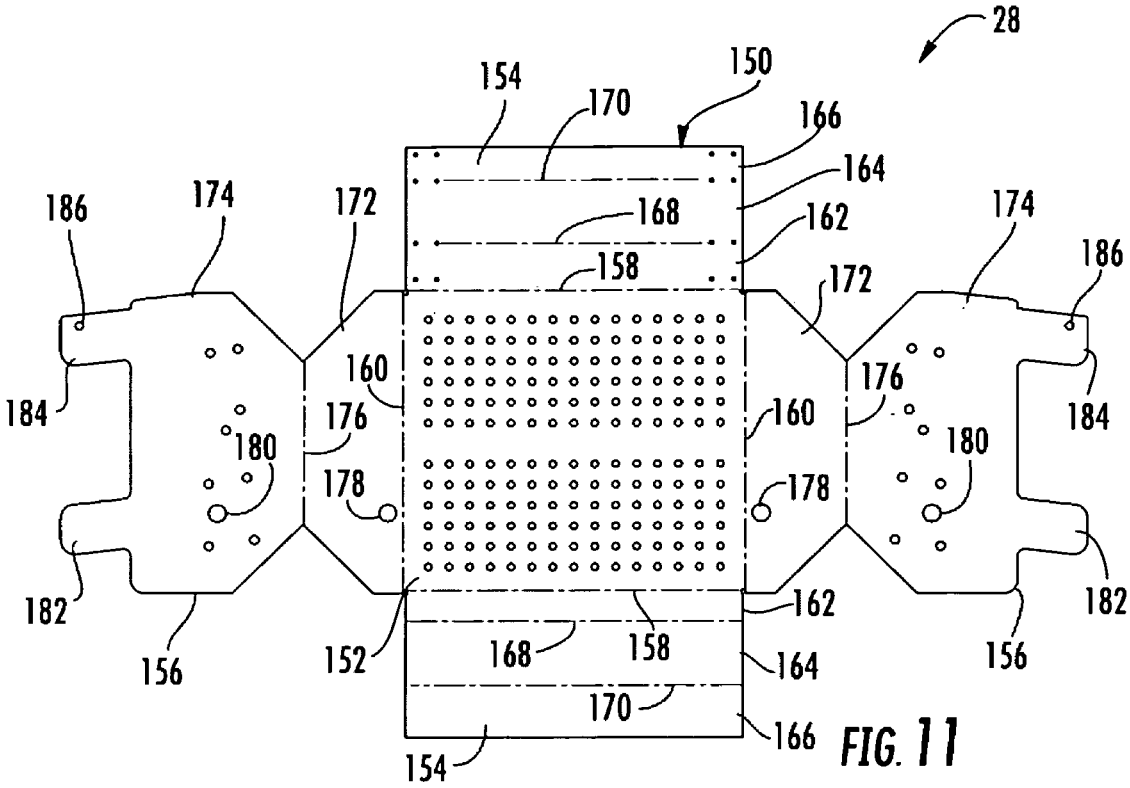
FIGS. 11 and 12A through 12C show successive steps in forming the support of FIGS. 9 and 10.

Referring to FIG. 11, base support 28 is formed preferably from a continuous piece 150 of metal. Piece 150 comprises a generally rectangular area 152, two generally rectangular areas (commonly denoted at 154) extending from opposite sides of area 152, and two flanges (commonly denoted at 156). Area 152 and areas 154 define fold lines 158, and area 152 and flanges 156 define fold lines 160. Areas 154 include three portions 162, 164, and 166, which define fold lines 168 and 170. Flanges 156 include two portions 172 and 174, which define fold lines 176, and also include at least two apertures 178 and 180. Portions 174 of flanges 156 include tabs 182 and 184 corresponding to tabs 148. In the presently-described embodiment, tabs 184 also include apertures 186.

Figure 12A:
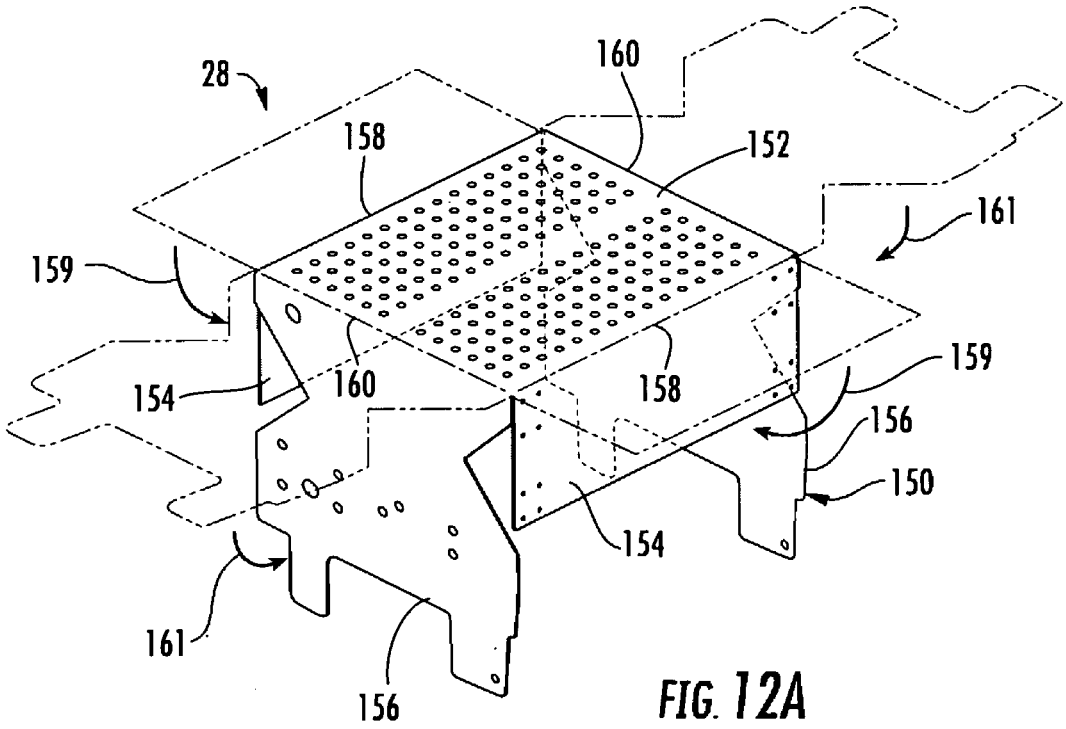
Figure 12B:
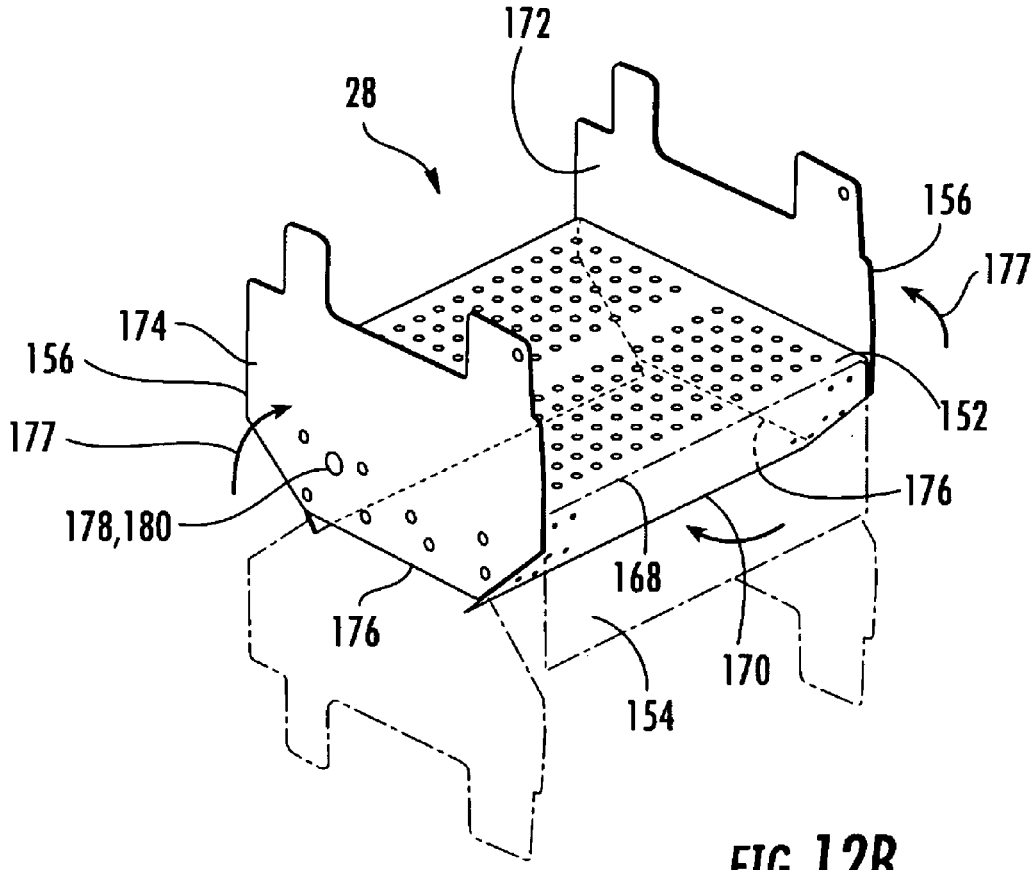
Figure 12C:
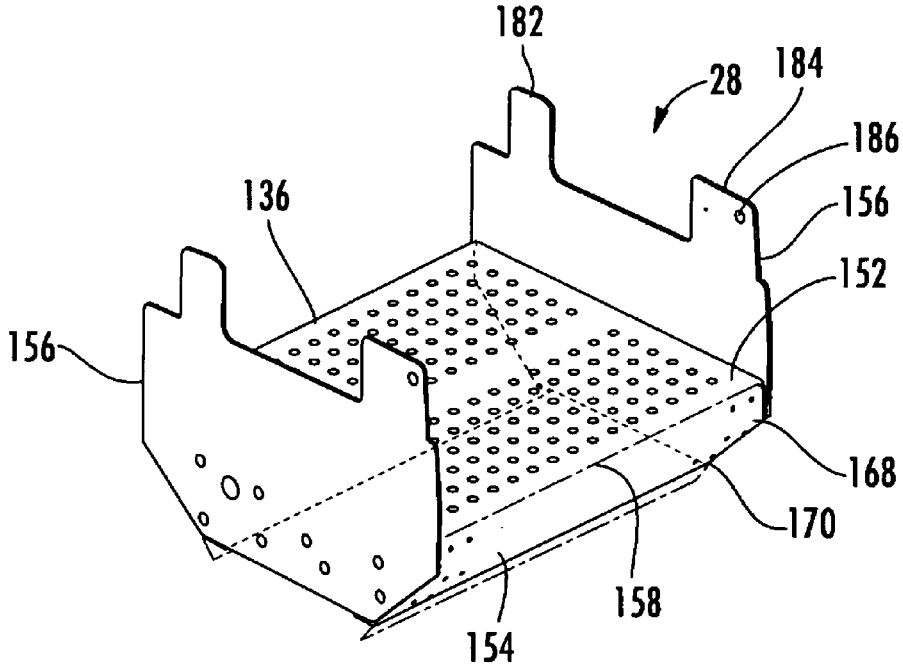

Referring to FIGS. 12A through 12C, base support 28 is formed by folding continuous piece 150 of metal at fold lines 158 and 160 (indicated by arrows 159 and 161) as shown in FIG. 12A. Flanges 156 are then back-folded at fold lines 176 (indicated by arrows 177) so that portions 174 overlap portions 172 and extend above the plane created by area 152 as shown in FIG. 12B. As a result, Apertures 178 and 180 will align. Flanges 156 are pivotally attached to left and right side supports by any suitable structure capable of allowing base support 28 to pivot with respect to the support structure (FIG. 2). As noted above, this can be accomplished by passing a rod through the coaligned holes, by rivets, bearings, and/or bushings pivotally connecting the base support to the support structure, or a combination of the two.

Areas 154 are angled at fold lines 168 and 170 such that the edges of each area 154 are adjacent to at least a portion of an edge of flanges 156 as shown in FIGS. 12B and 12C. As noted above, in one embodiment, these adjacent edges may be welded together in order to provide additional structural support. In another embodiment, tabs 182 and 184 are welded or otherwise attached to guardrails 38 (FIG. 2). Portions of flanges 156 extending above the plane created by area 152 also provide foot guardrails.

Referring to FIG. 11, in another embodiment, portions 174 of flanges 156 are separated from portions 172 by butterflying or otherwise cutting along fold lines 176. After base support 28 is formed in a manner otherwise identical to that described above with respect to FIGS. 12A through 12C, separated portions 174 are positioned adjacent to portions 172. The edges of portions 174 that overlap the edges of portions 154 and 172 are welded to the overlapping edges of portions 154 and 172. Base support 28 otherwise resembles base support 28 described above.

Figure 13:
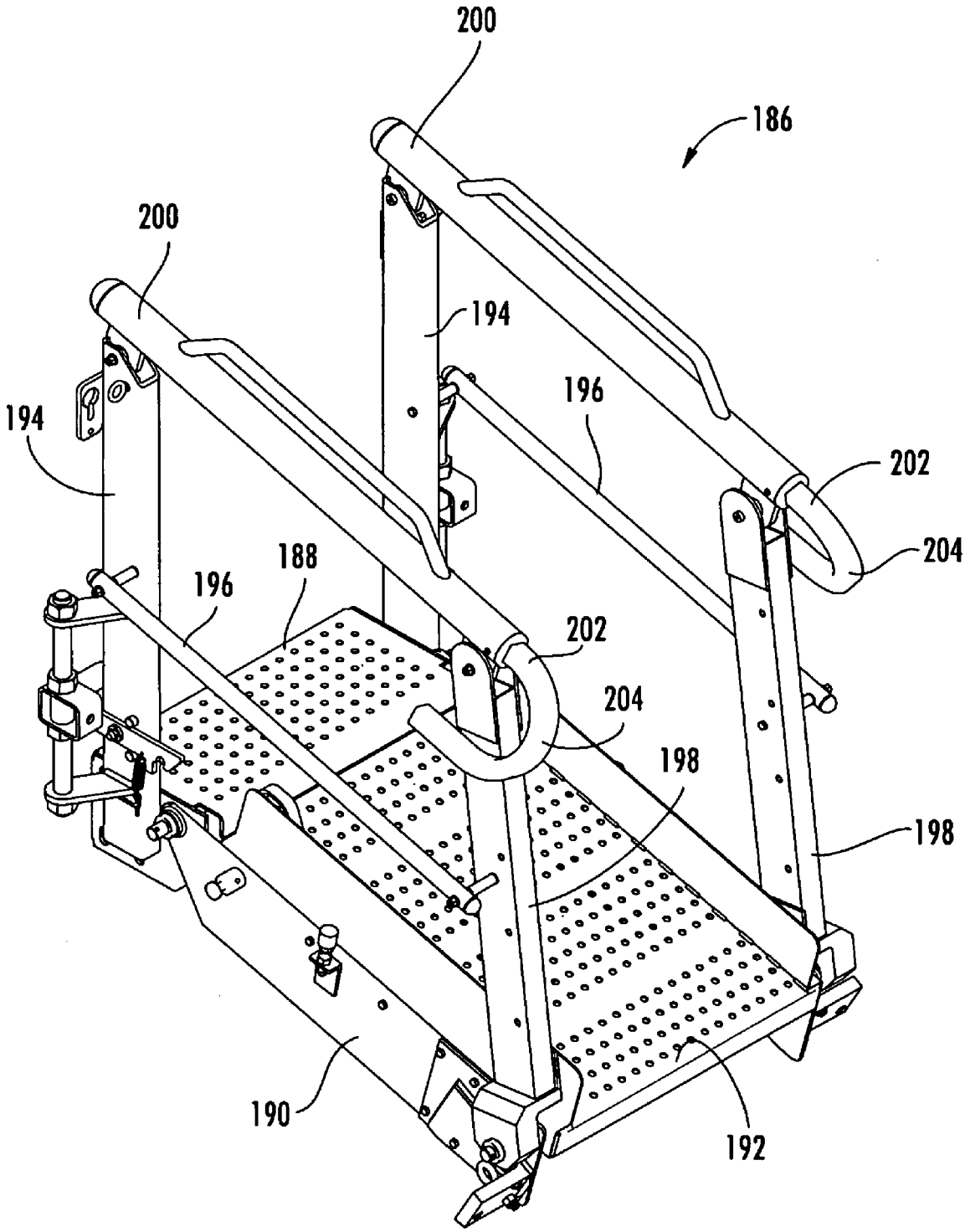
FIG. 13 is a perspective view of a gangway in accordance with another embodiment of the present invention.

FIG. 13 illustrates a gangway 186 in accordance with another embodiment of the present invention. As shown, gangway 186 is comprised of a support platform 188, a support structure 190, and a ramp 192. Ramp 192 is affixed to support structure 190, which is pivotally attached to support platform 188 such that the support structure and ramp are able to pivotally rotate relative to the support platform. Alternatively, support structure 190 is pivotally attached to another support structure to which guardrails 194 and support platform 188 are attached. Additionally, support platform 188 may be constructed and operate in a manner identical to top support 24 of FIG. 2. Support platform 188 may be connected to a fixed structure such as platform 18 or stairwell 16 illustrated in FIG. 1.

Gangway 186 includes several other support structures, such as guardrails 194 and 198, midrails 196, and handrails 200 that should be understood by those of ordinary skill in the relevant art. Handrails 200 may also include retractable segments 202 capable of retracting within the handrails and extending out from the handrails. As shown, retractable segments 202 may terminate in hook-shaped segments 204, which can be attached to the relevant storage container or to a structure connected to the relevant storage container in order to provide additional stability. Additionally, two counterbalanced springs may be connected to guardrails 194 and 198 on each side of gangway 186 or support structure 190. Heavy-duty chains may be used to secure gangway 186 in a certain orientation.

In operation, support structure 190 and ramp 192 pivot relative to support platform 188 so that gangway 186 may be raised or lowered in order to position the end of the ramp adjacent to the relevant container. Support structure 190 may be rotated such that ramp 192 retracts into a generally vertical position. In a preferred embodiment, counterbalanced springs connected to guardrails 194 and 198 and/or support structure 190 allow ramp 192 to be easily rotated up and down.

Figure 14:
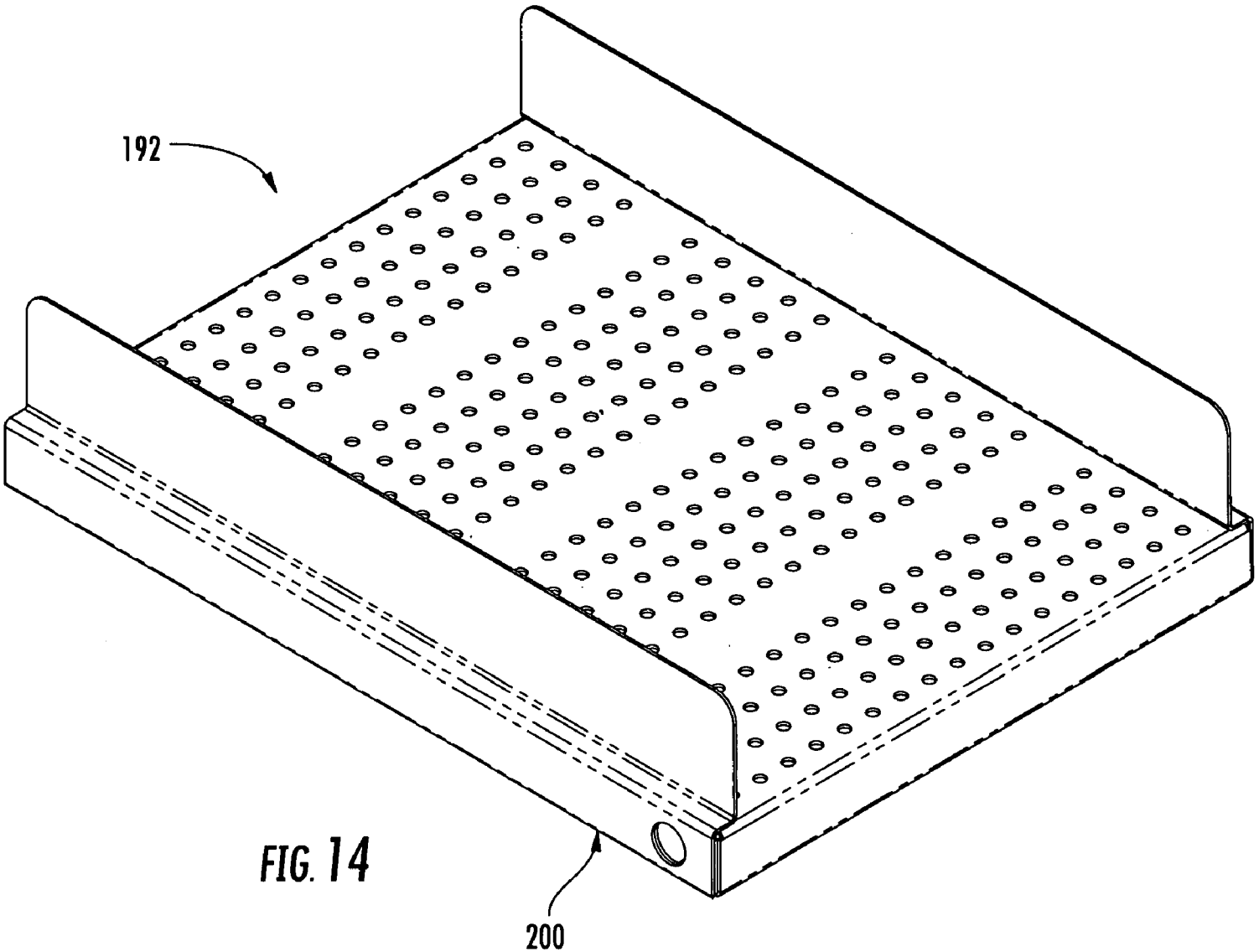
FIG. 14 is a perspective view of a ramp of the gangway of FIG. 13.
Figure 15A:
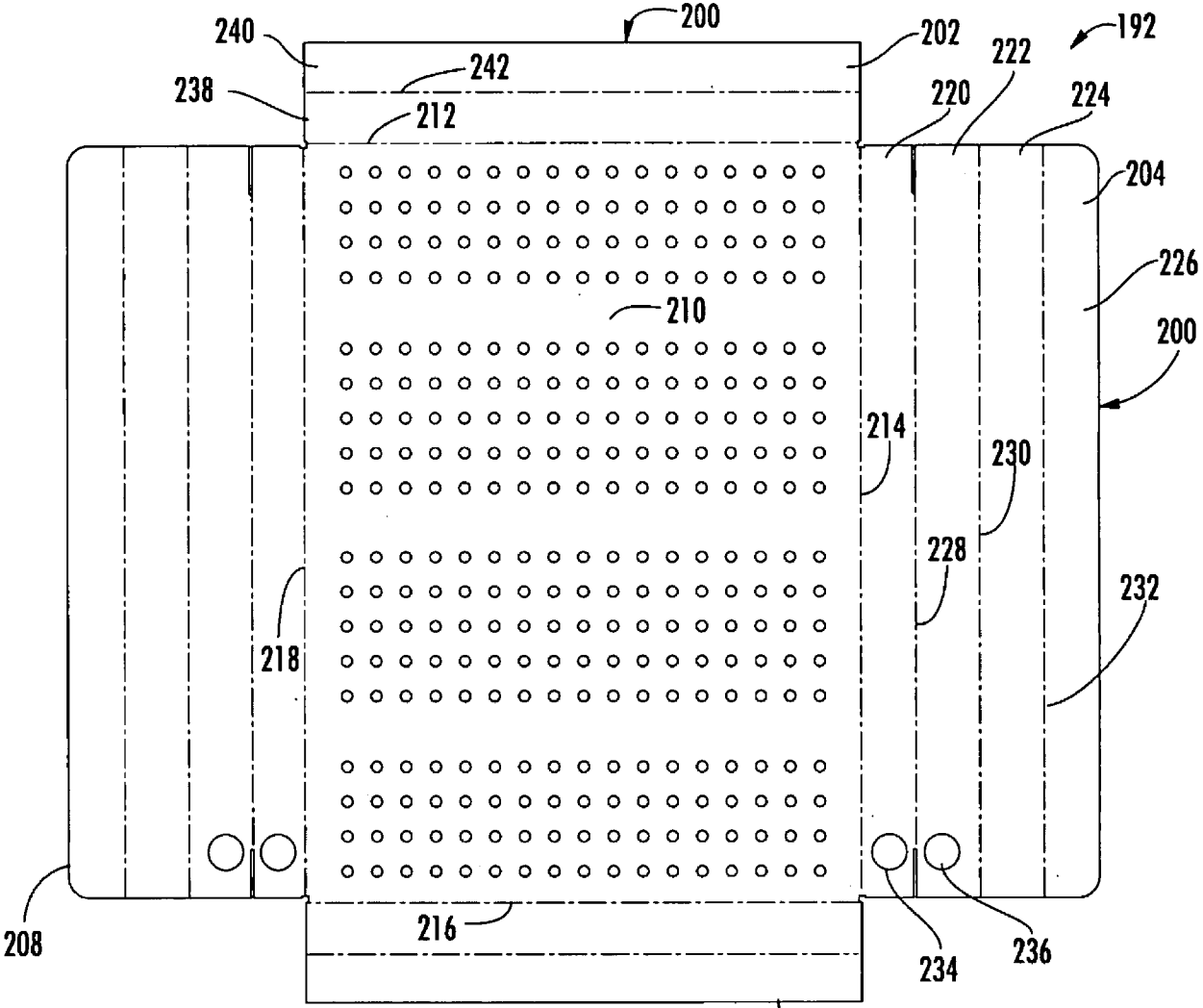
FIGS. 15A through 15D are perspective views illustrating an exemplary process of forming the ramp of FIG. 14.

Referring to FIG. 14, ramp 192 is preferably formed from a continuous piece 200 of metal. Referring to FIG. 15A, piece 200 comprises four generally rectangular areas 202, 204, 206, and 208 generally surrounding another generally rectangular area 210. Area 210 and areas 202, 204, 206, and 208 define fold lines 212, 214, 216, and 218, respectively. Because area 202 is identical to area 206, and area 204 is identical to area 208, the following description is directed to areas 202 and 204 only. Area 204 comprises portions 220, 222, 224, and 226 which define fold lines 228, 230, and 232 between the portions. Portion 220 defines an aperture 234, and portion 222 defines another aperture 236. Area 202 comprises two portions 238 and 240, which define fold line 242 between the portions.

Figure 15B:
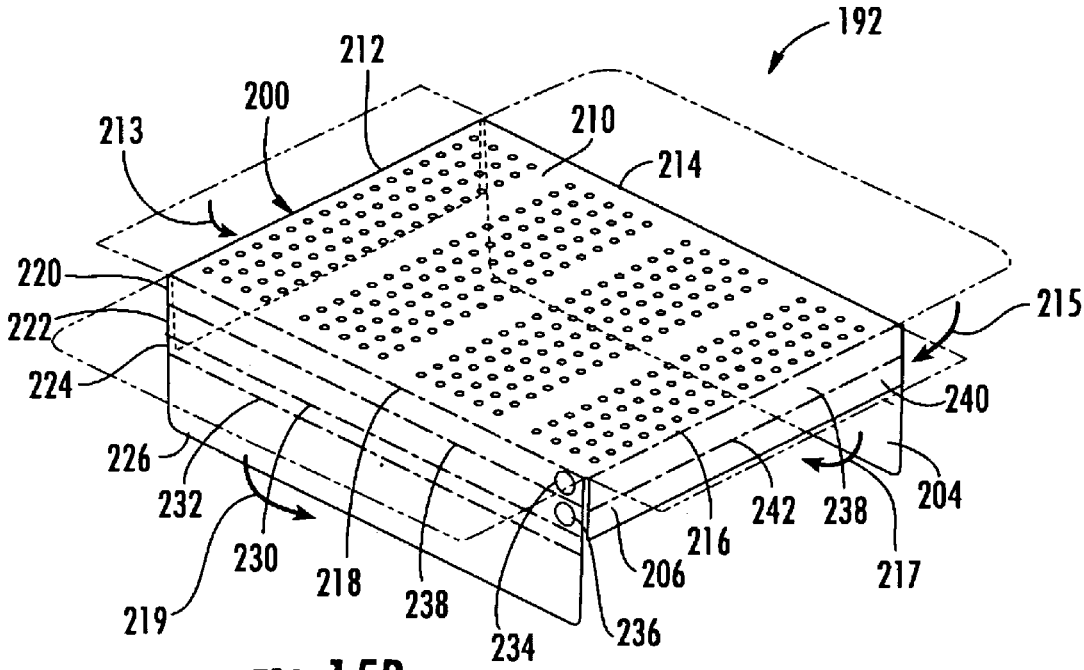
Figure 15C:
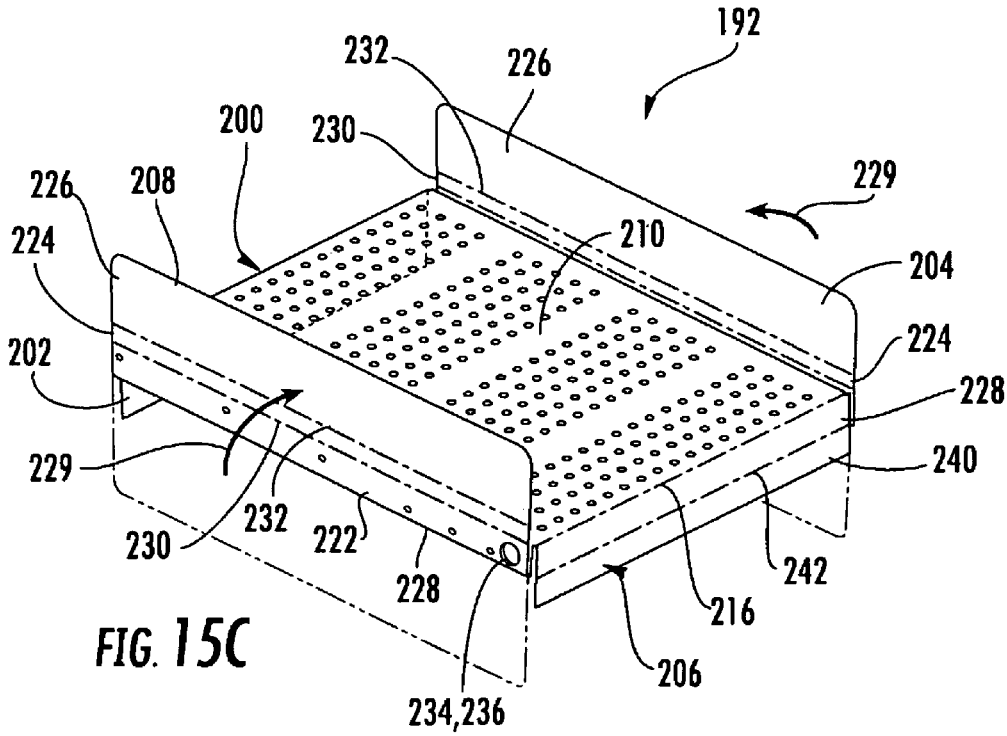
Figure 15D:
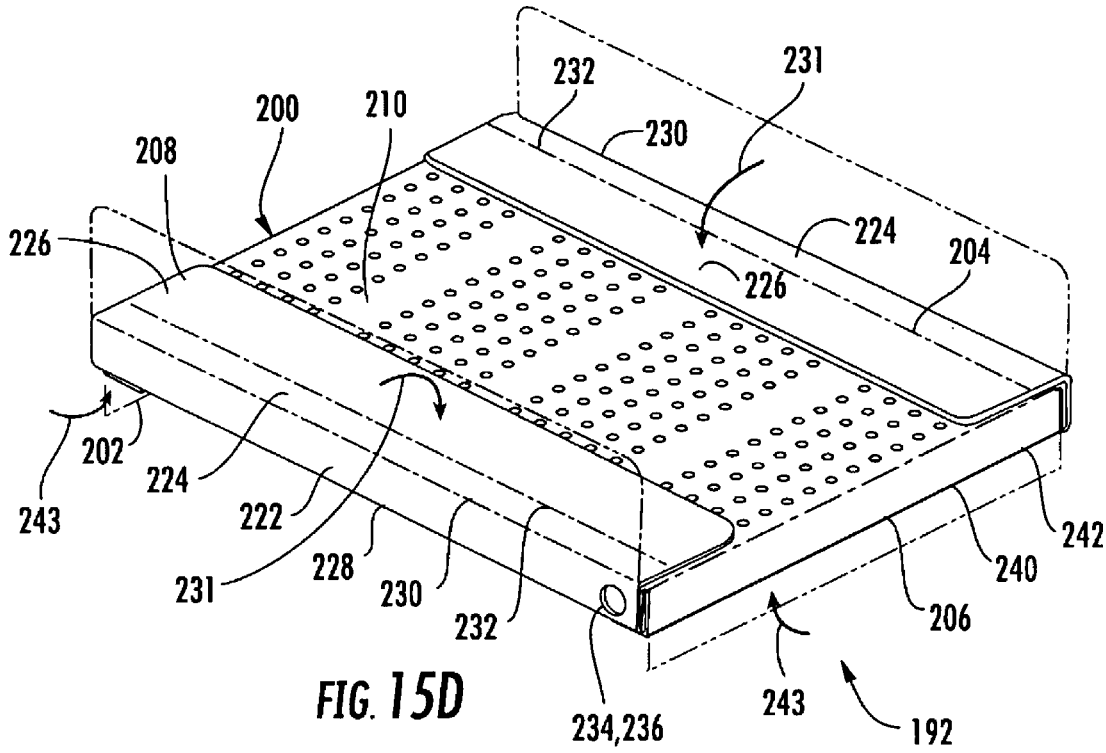
Figure 15E:
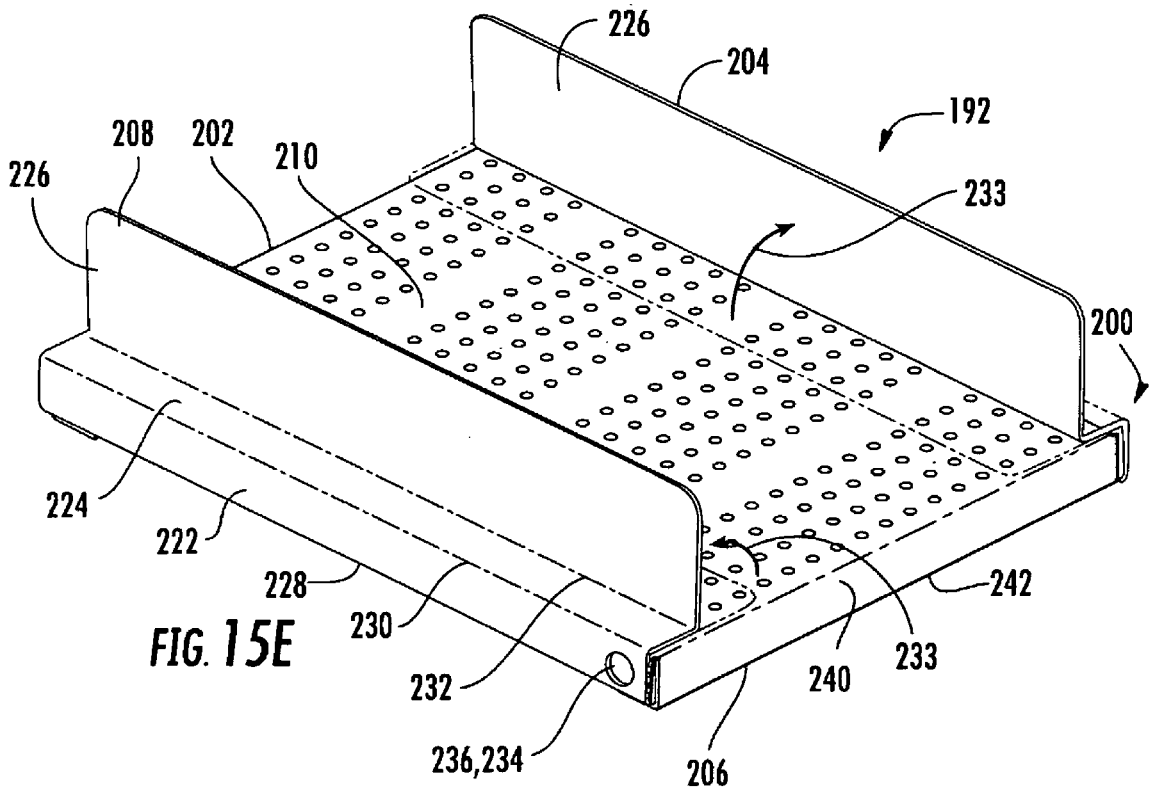

Referring to FIGS. 15B through 15E ramp 192 is formed by folding continuous piece 200 of metal at fold lines 212, 214, 216, and 218 (indicated by respective arrows 213, 215, 217, and 219) as shown in FIG. 15B. Areas 204 and 208 are back-folded at fold lines 228 such that portions 220 and portions 222 of the respective areas overlap, thereby causing apertures 234 and apertures 236 to coalign as shown in FIG. 15C. As shown in FIG. 15D, areas 204 and 208 are again folded at fold lines 230 (indicated by arrows 231). Areas 204 and 208 are folded once more at fold lines 232 (indicated by arrows 233) such that portions 226 extend vertically above and perpendicular to area 210 as shown in FIG. 15E. It should be understood from the above description that areas 204 and 208 are folded in identical manners in this embodiment. Areas 202 and 206 are folded at fold lines 242 (indicated by arrows 243) such that portions 240 extend in a plane parallel to the plane of area 210 as shown in FIG. 15E. It should be understood from the above description that areas 202 and 206 are folded in an identical manner in this embodiment.

Ramp 192 is attached to support structure 190 (FIG. 13) by any suitable connector mechanism such as a shaft, bar, rod, rivet, and/or bushing passing through coaligned apertures 234 and 236 of areas 204 and 208 and attaching to the support structure. Vertically extended portions 226 of areas 204 and 208 desirably provide foot guardrails.

Figure 16:
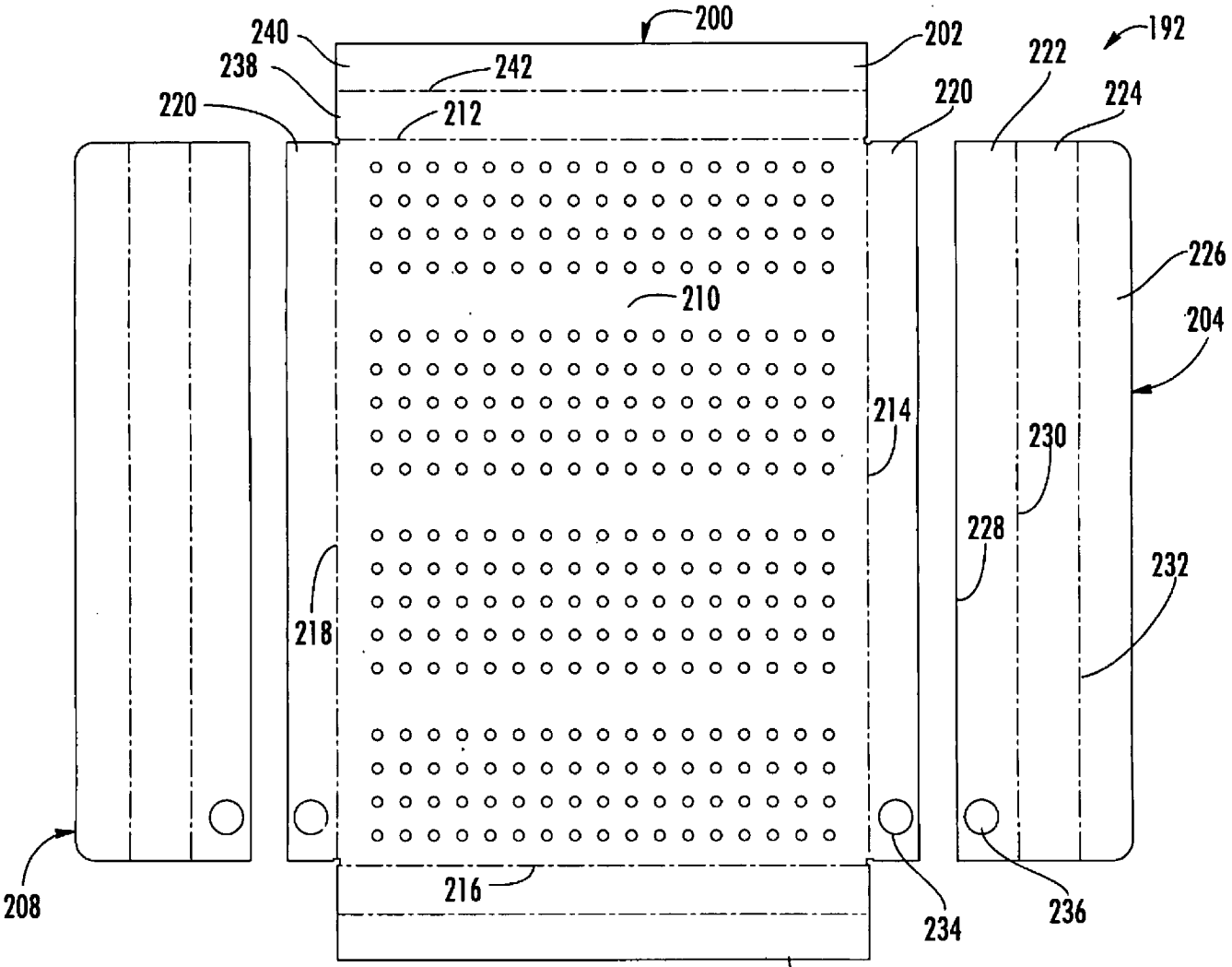
FIG. 16 is a top planar view of metal used to form the ramp of FIG. 14 in accordance with another embodiment of the present invention.

In another embodiment illustrated by FIG. 16, ramp 192 is formed from continuous pieces 200, 204, and 208 of metal in a manner similar to that described above with respect to FIGS. 15A through 15E. In the presently-described embodiment, areas 202 and 206 are folded with respect to area 210 in a manner identical to that described above with respect to FIGS. 15A through 15E. Likewise, portions 220 are folded in a manner identical to that described above with respect to FIG. 15B. Continuous pieces 204 and 208 of metal are folded in a manner identical to that described above with respect to portions 222, 224, and 226 of area 204 of FIGS. 15C through 15E. In the presently-described embodiment, continuous pieces 204 and 208 of metal are attached (e.g., welded) to continuous piece 200 of metal in a configuration similar to the one shown in FIG. 15E to form ramp 192.

Figure 17:
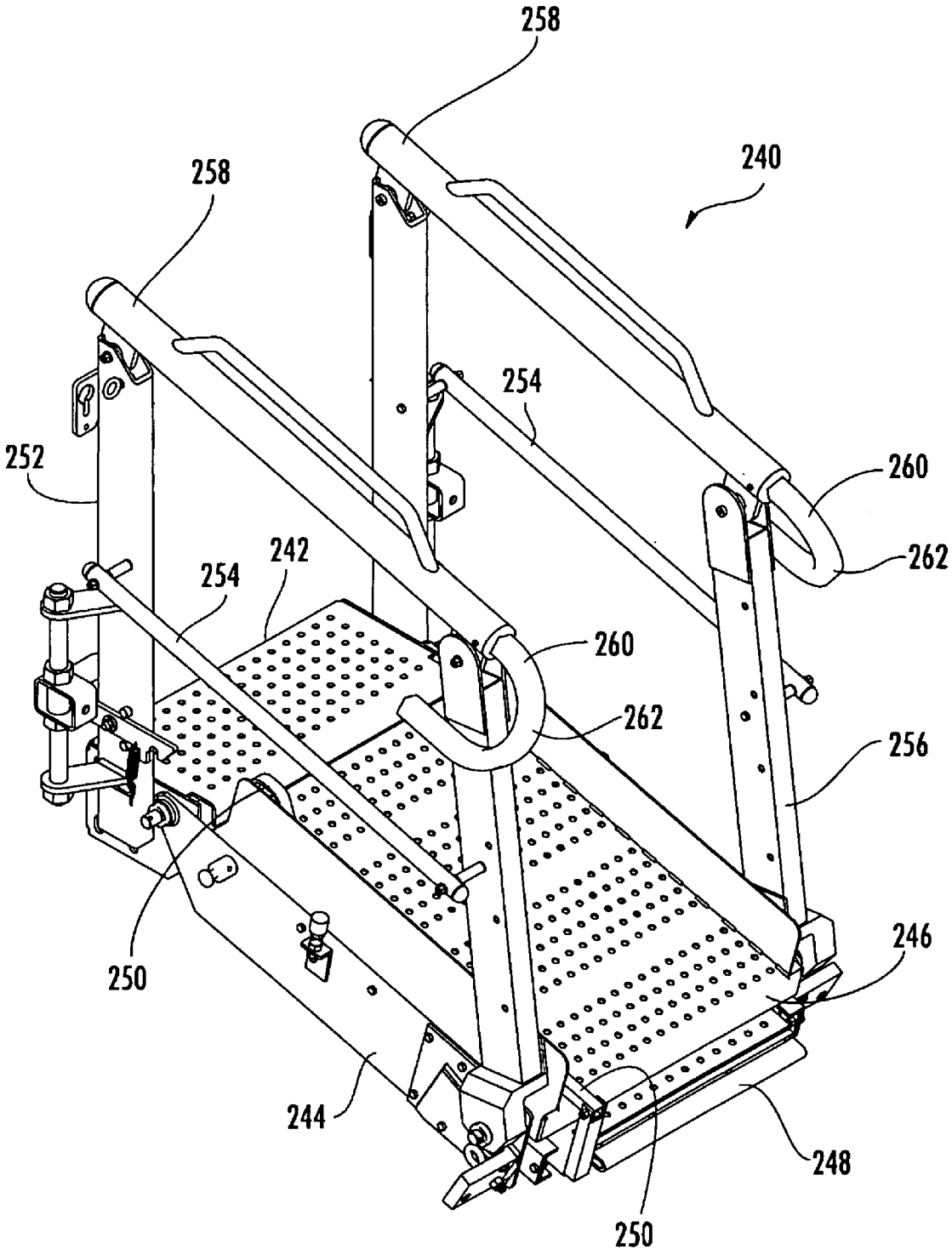
FIG. 17 is a perspective view of a gangway in accordance with another embodiment of the present invention.

FIG. 17 illustrates a gangway 240 in accordance with another embodiment of the present invention. As shown, gangway 240 is comprised of a support platform 242, a support structure 244, a ramp 246, and a telescoping ramp 248. Ramp 246 is connected to support structure 244, which is pivotally attached to support platform 242 or to another support structure such that support structure 244 and ramp 246 are able to pivotally rotate relative to support platform 242. Support platform 242 may be connected to a fixed structure such as platform 18 or stairwell 16 illustrated in FIG. 1. Support platform may be constructed and operate in a manner identical to top support 24 of FIG. 2. Telescoping ramp 248 is located between ramp 246 and support structure 244 and is configured to slideably extend outward from and retract underneath ramp 246. Telescoping ramp 248 may include a rotating arm 250 used to maintain it in a desired position.

Gangway 240 may include several other support structures, such as guardrails 252 and 256, midrails 254, and handrails 258, that should be understood by those of ordinary skill in the relevant art. Handrails 258 may also include retractable segments 260 capable of retracting within the handrails and extending out from the handrails. As shown, retractable segments 260 may terminate in hook-shaped configurations 262, which can be attached to the relevant storage container or a structure connected to the relevant storage container in order to provide additional stability. Additionally, two counterbalanced springs may be connected to guardrails 252 and 256 on each side of gangway 240 or to support structure 244. Heavy-duty chains may be attached to guardrails 252 and 256 to secure gangway 240 in a specific orientation.

In operation, support structure 244, ramp 246, and telescoping ramp 248 pivot relative to support platform 242 so that gangway 240 may be raised or lowered in order to position the end of ramp 216 adjacent to the relevant container. Telescoping ramp 248 may then be moved so as to extend from ramp 216 to a desired position to span any gap between ramp 246 and the storage container. Rotating arm 250 is then used to secure telescoping ramp 248 to ramp 246 in order to maintain telescoping ramp 248 in a fixed position. For example, rotating arm 250 may have a transverse pin at its distal end which is inserted through aligned traction holes in ramp 246 and telescoping ramp 248. The user may hold telescoping arm 250 as a handle in order to facilitate extension and retraction of telescoping ramp 248. Support structure 244 may be rotated such that ramp 246 retracts into a generally vertical position. In a preferred embodiment, counterbalanced springs connected to guardrails 252 and 256 and/or support structure 244 allow ramps 246 and 248 to be easily rotated.

Figure 18:
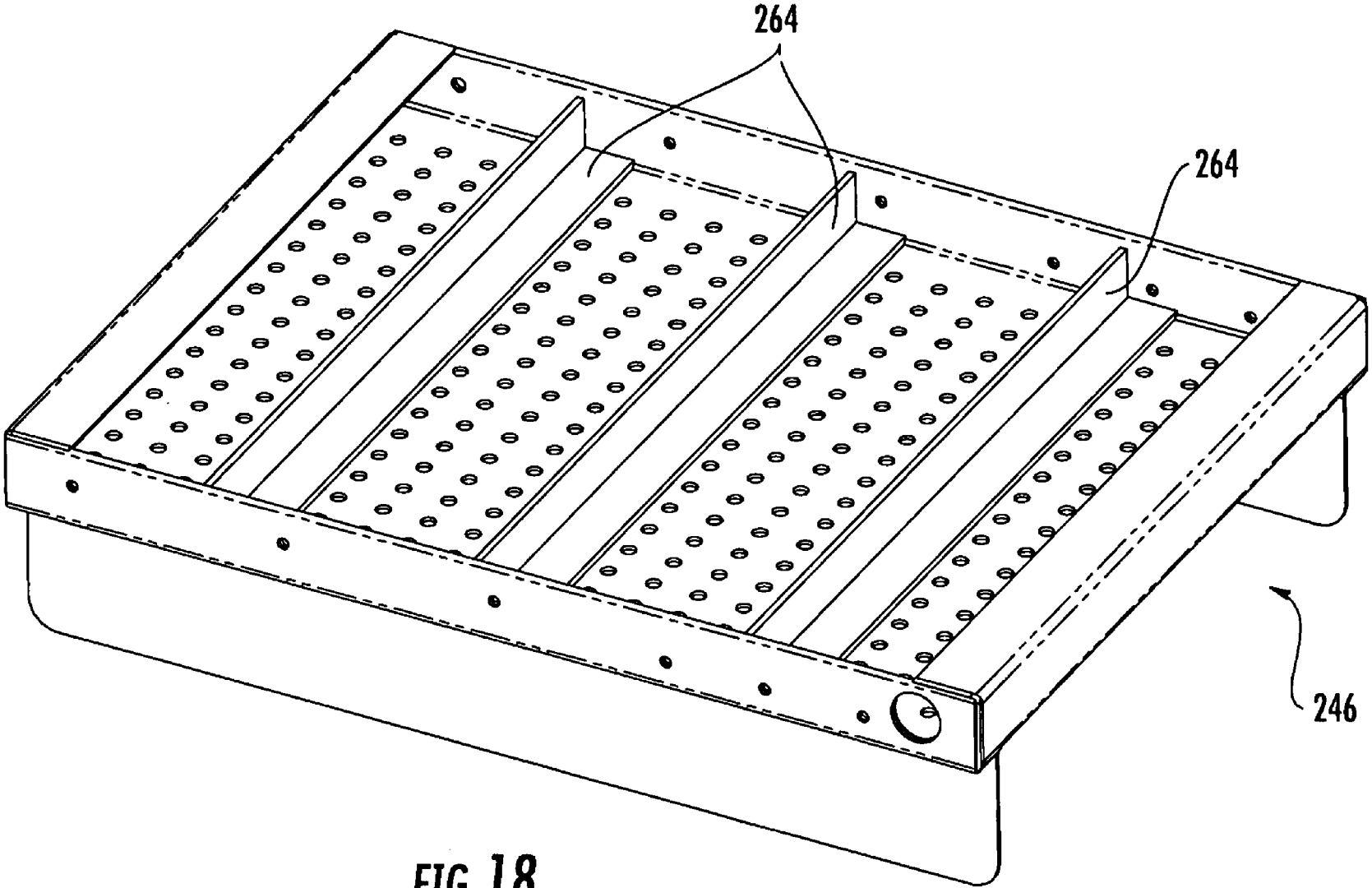
FIG. 18 is a perspective view of a ramp of the gangway of FIG. 17.

Ramp 246 may be constructed and formed from a continuous piece of metal in a manner identical to that described above with respect to ramp 192 of FIGS. 14 through 16D. As shown in FIG. 18, a number of additional supports 264 may be attached to the underneath of ramp 246 for added stability. Supports 264 may be attached to ramp 246 by welding or any suitable means. Although supports 264 as illustrated in FIG. 18 comprise two generally planar pieces of metal, it should be understood that other standard reinforcement materials of additional shapes, sizes, and configurations, such as rectangular or conical tubes, bars or rods, tees or T-beams, or I-beams, may be used.

Figure 19A:
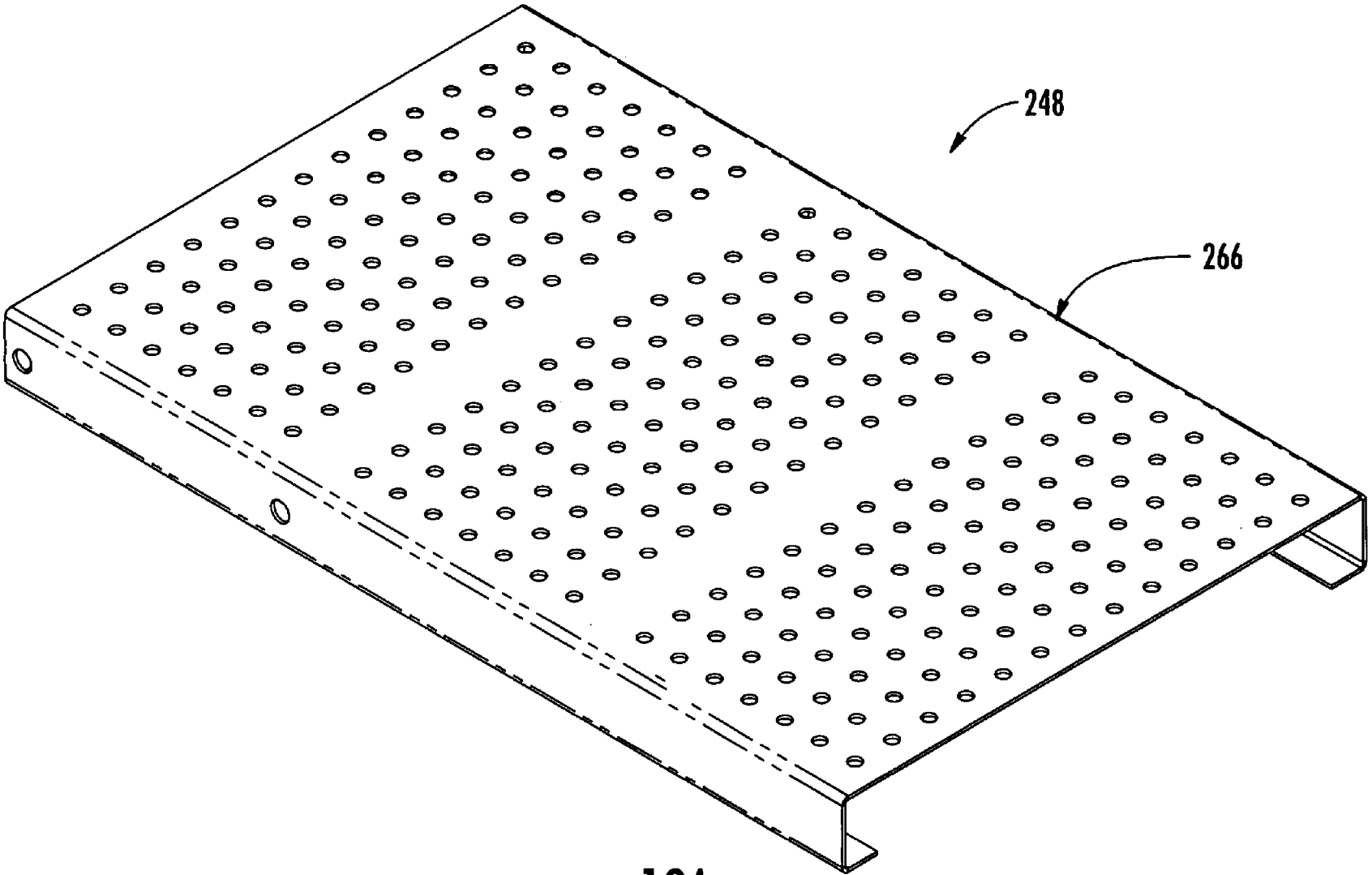
FIG. 19A is a perspective view of a telescoping ramp of the gangway of FIG. 17.
Figure 19B:
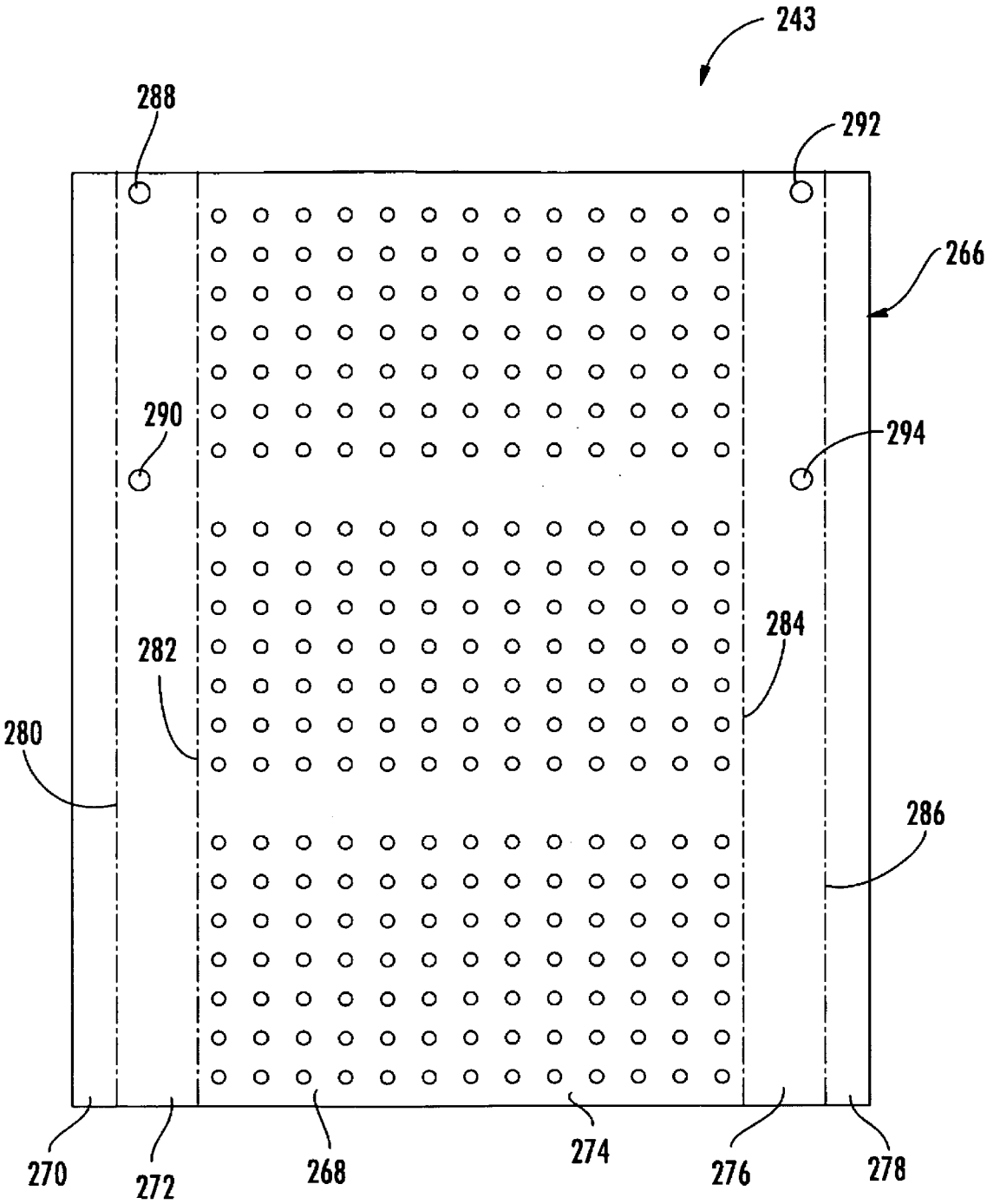
FIGS. 19B through 19D are perspective views illustrating an exemplary process of forming the telescoping ramp of FIG. 19A.

Referring to FIG. 19A, telescoping ramp 248 is preferably formed from a continuous piece 266 of metal. Referring to FIG. 19B, piece 266 comprises a generally rectangular area 268 having portions 270, 272, 274, 276, and 278, defined by fold lines 280, 282, 284, and 286. Portions 272 and 276 define apertures 288, 290, 292, and 294. Apertures 288, 290, 292, and 294 may be used to connect telescoping ramp 248 to ramp 246 such that the telescoping ramp is able to be extended and retracted.

Figure 19C:
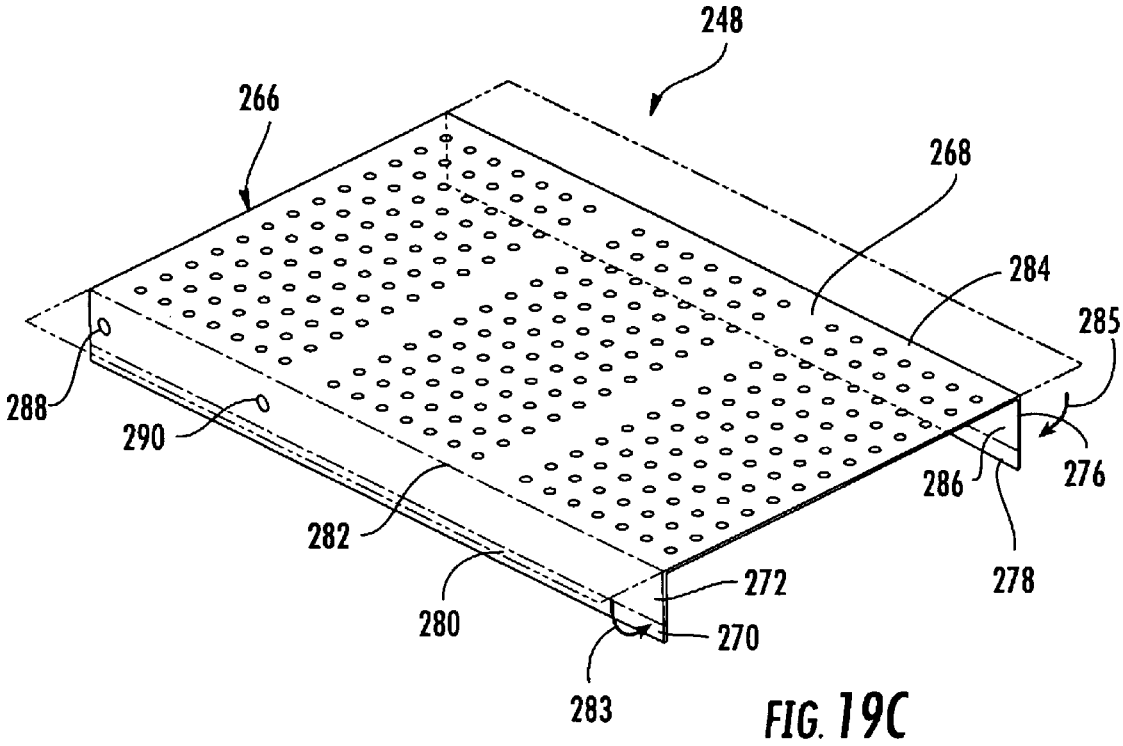
Figure 19D:
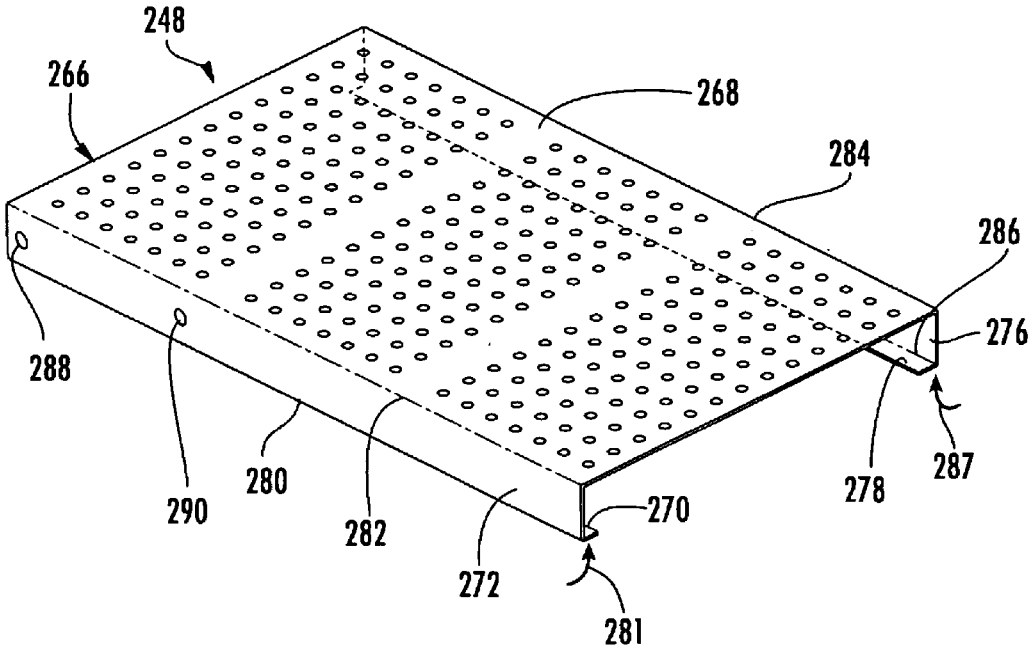

Referring to FIGS. 19C and 19D, ramp 248 is formed by folding continuous piece 266 of metal at fold lines 282 and 284 (indicated by respective arrows 283 and 285) as shown in FIG. 19C. Piece 266 is folded again at fold lines 280 and 286 (indicated by respective arrows 281 and 287) such that portions 270 and 278 are coplanar with each other and are parallel to the plane of area 268 (as shown in FIG. 19D).

Figure 19E:
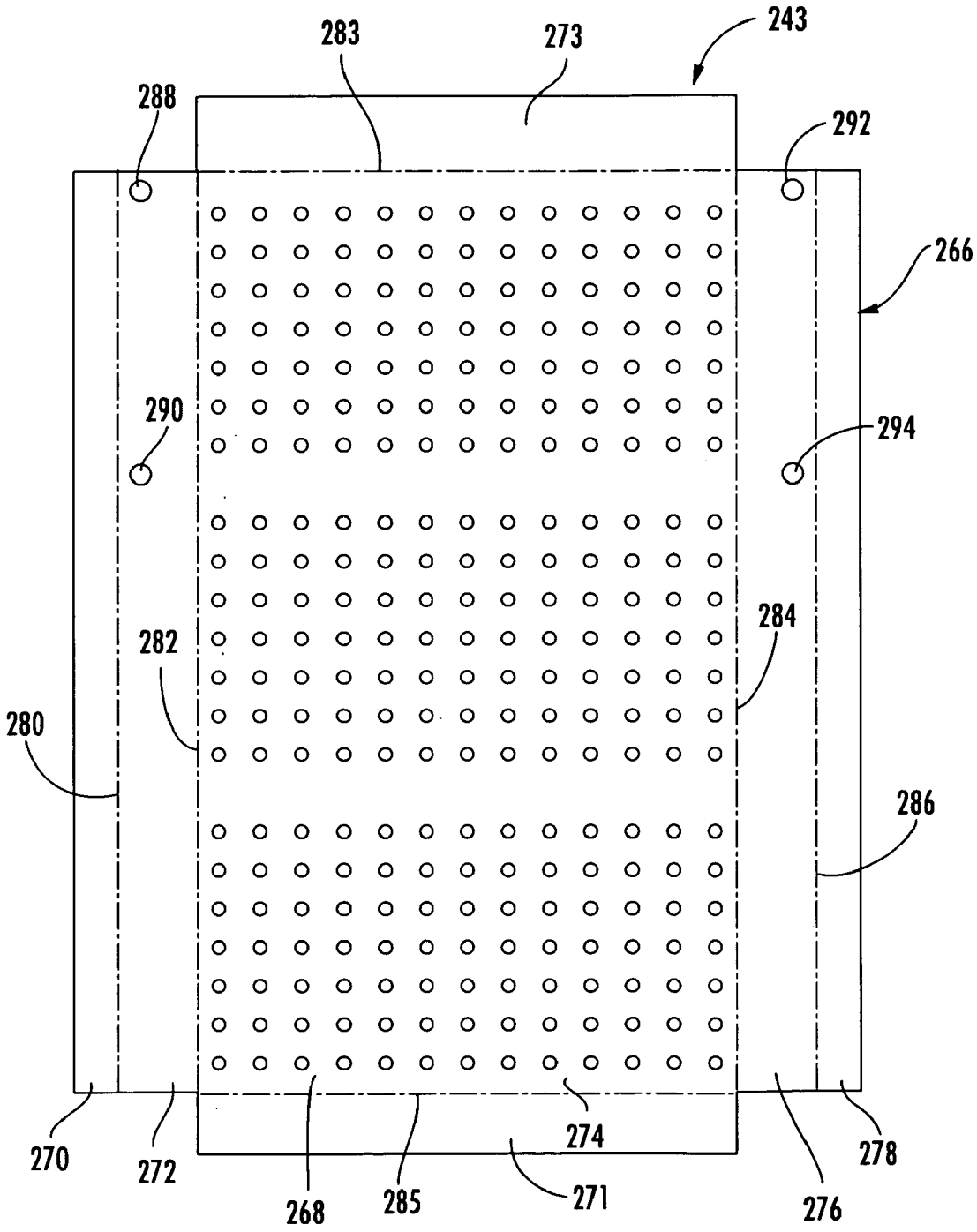
FIGS. 19E and 19F are perspective views illustrating an exemplary process of forming the telescoping ramp of the gangway of FIG. 17.
Figure 19F:
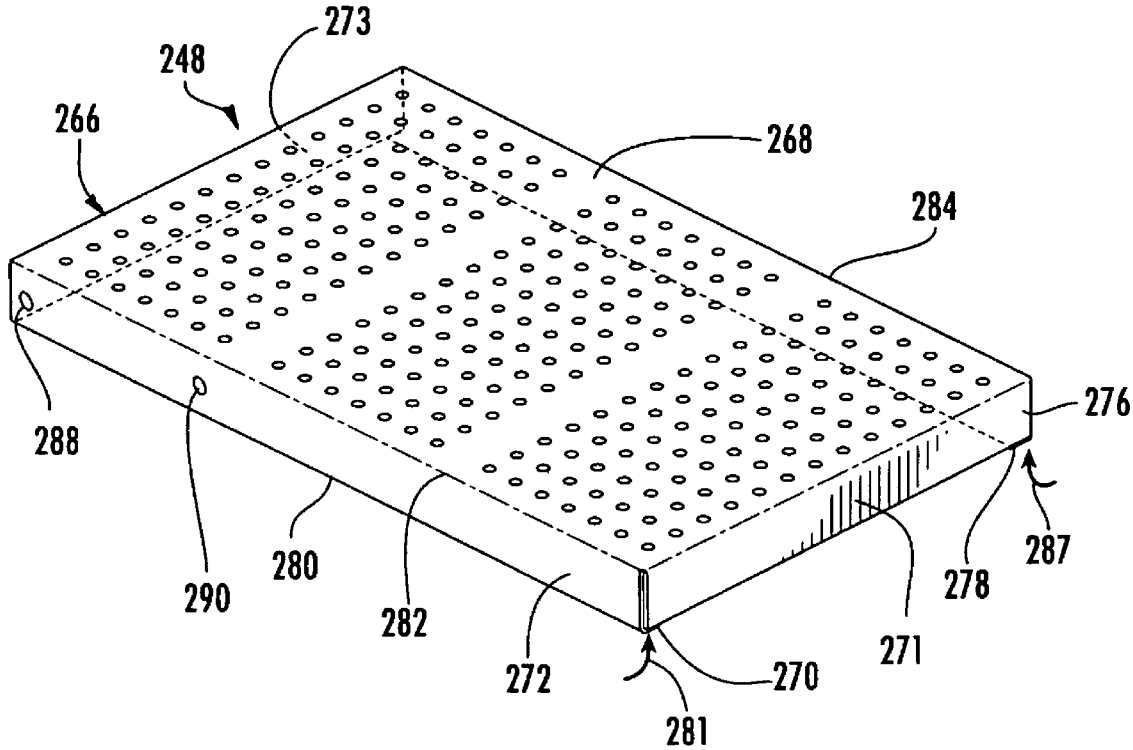

Referring to FIGS. 19E and 19F, in another embodiment, continuous piece 266 of metal includes additional portions 271 and 273 extending from respective ends of rectangular portion 268. Ramp 266 is otherwise constructed and formed in a manner identical to that described above with respect to FIGS. 19A through 19D. Additionally, in the presently-described embodiment, portions 271 and 273 are folded downward with respect to rectangular portion 268 along fold lines 285 and 283, respectively.

Figure 20A:
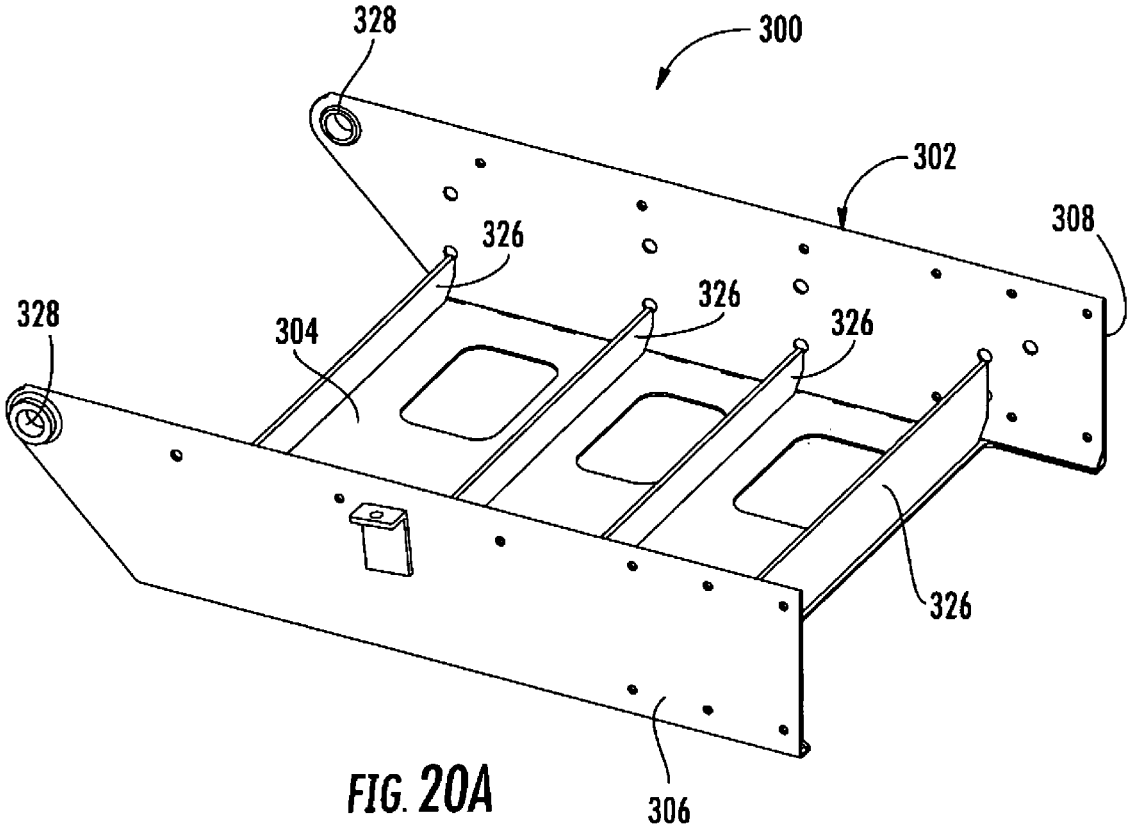
FIG. 20A is a perspective view of a support structure in accordance with another embodiment of the present invention.
Figure 20B:
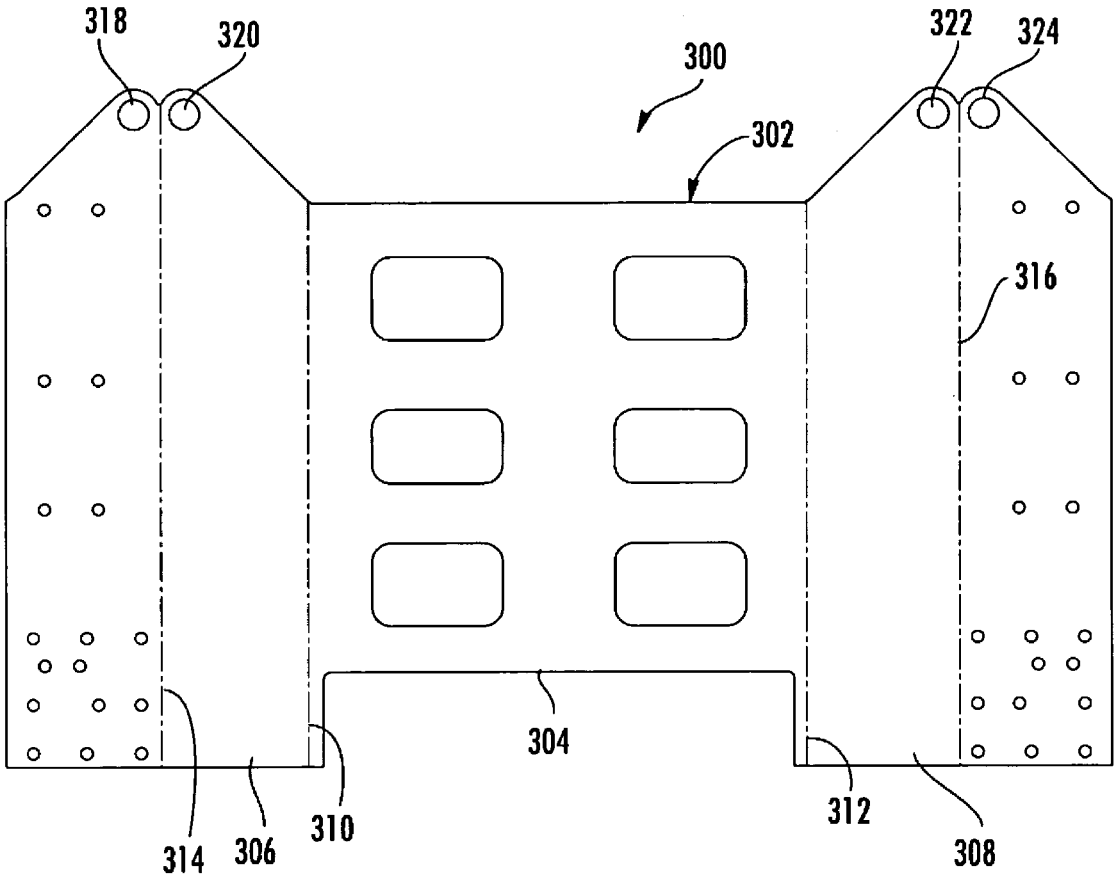
FIGS. 20B through 20D are perspective views illustrating an exemplary process of forming the support structure of FIG. 20A.

FIGS. 20A through 20D illustrate a support structure, or an "underbody," or a "u-body" 300 in accordance with an embodiment of the present invention. Referring to FIG. 20A, support structure 300 is formed from a continuous piece 302 of metal. Referring to FIG. 20B, continuous piece 302 of metal comprises a generally rectangular area 304 and two wing areas 306 and 308 separated from area 304 by fold lines 310 and 312, respectively. Wing areas 306 and 308 include additional respective fold lines 314 and 316. Area 306 defines two main apertures 318 and 320 and several additional apertures, while area 308 defines main apertures 322 and 324 and several additional apertures.

Figure 20C:
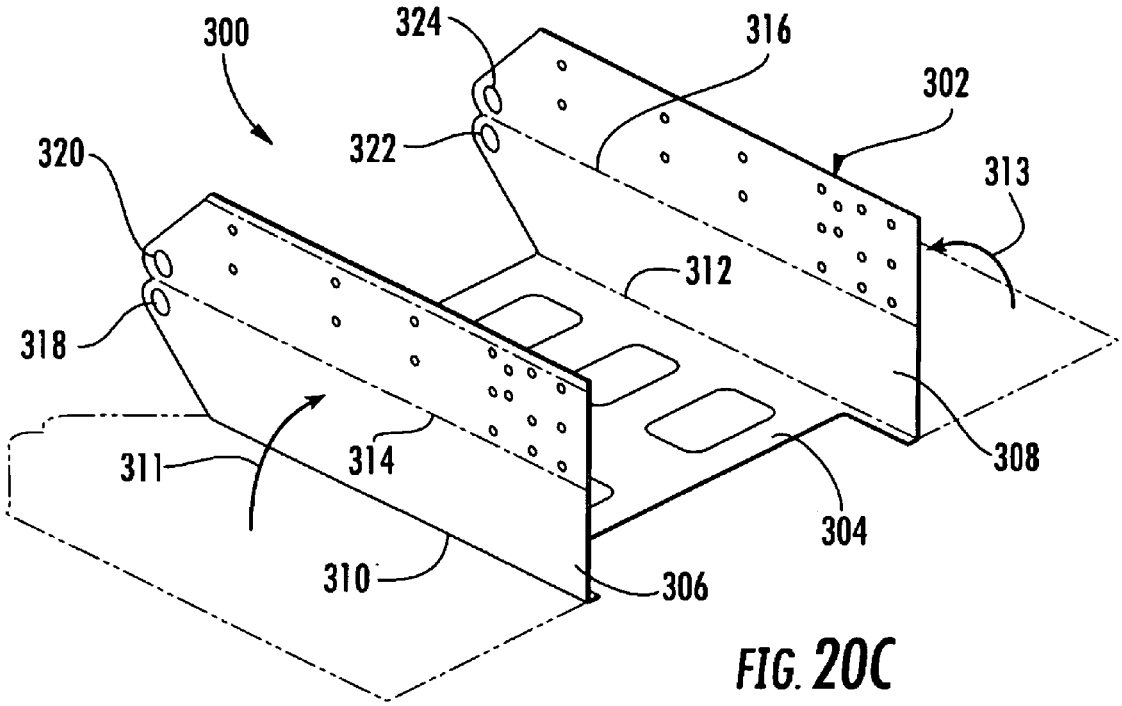
Figure 20D:
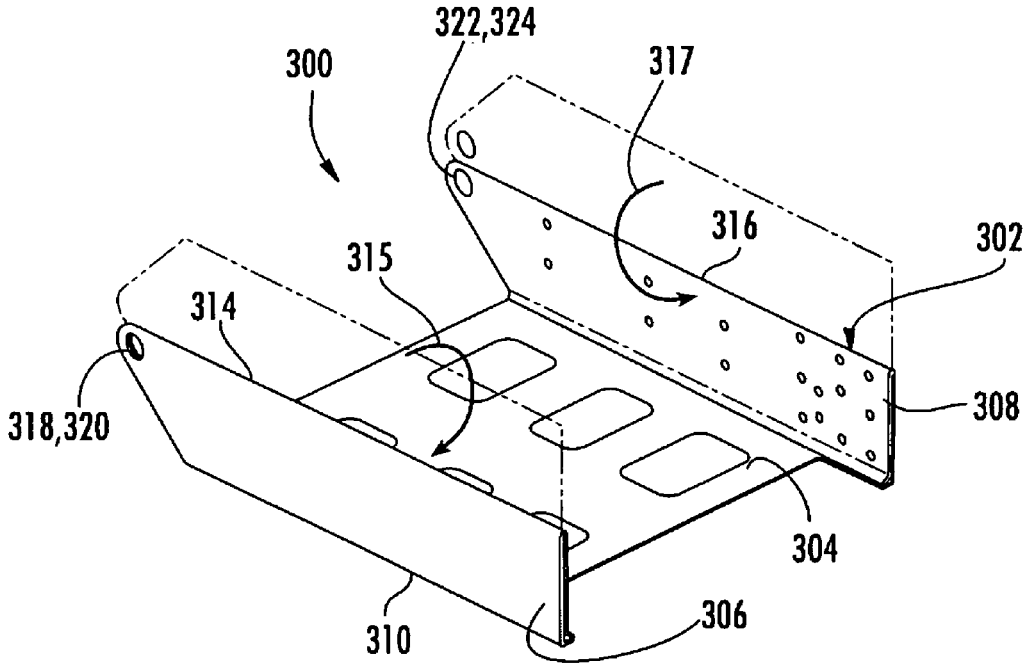

Referring to FIG. 20C, support structure 300 is formed by folding continuous piece 302 of metal at fold lines 310 and 312 (indicated by arrows 311 and 313, respectively). Wing pieces 306 and 308 are then back-folded at fold lines 314 and 316, respectively (indicated by arrows 315 and 317), such that apertures 318, 320, 322 and 324 align as shown in FIG. 20D.

Referring again to FIG. 20A, several horizontal support beams 326 may be attached (e.g., welded) to areas 304, 306, and 308 for additional stability. Structures 328 are also attached to the outside of wing areas 306 and 308 at apertures 318, 320, 322, and 324. Structures 328 allow support structure 300 to be pivotally attached to another structure, such as support platform 242 (FIG. 17), and may be any suitable devices that allow support structure 300 to attach to and pivot relative to another structure, such as bolted or axled joints.

Figure 20E:
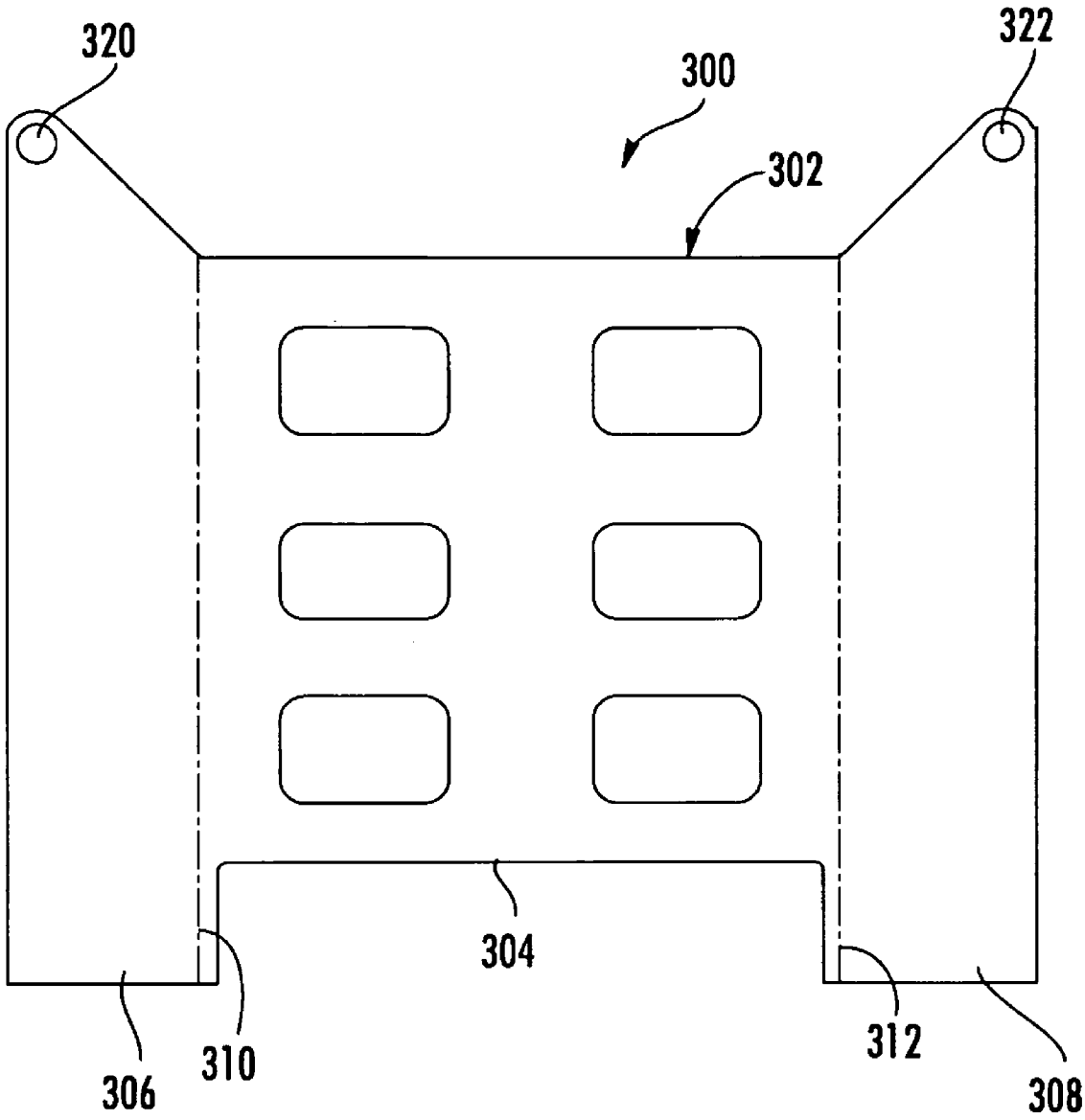
Figure 20F:
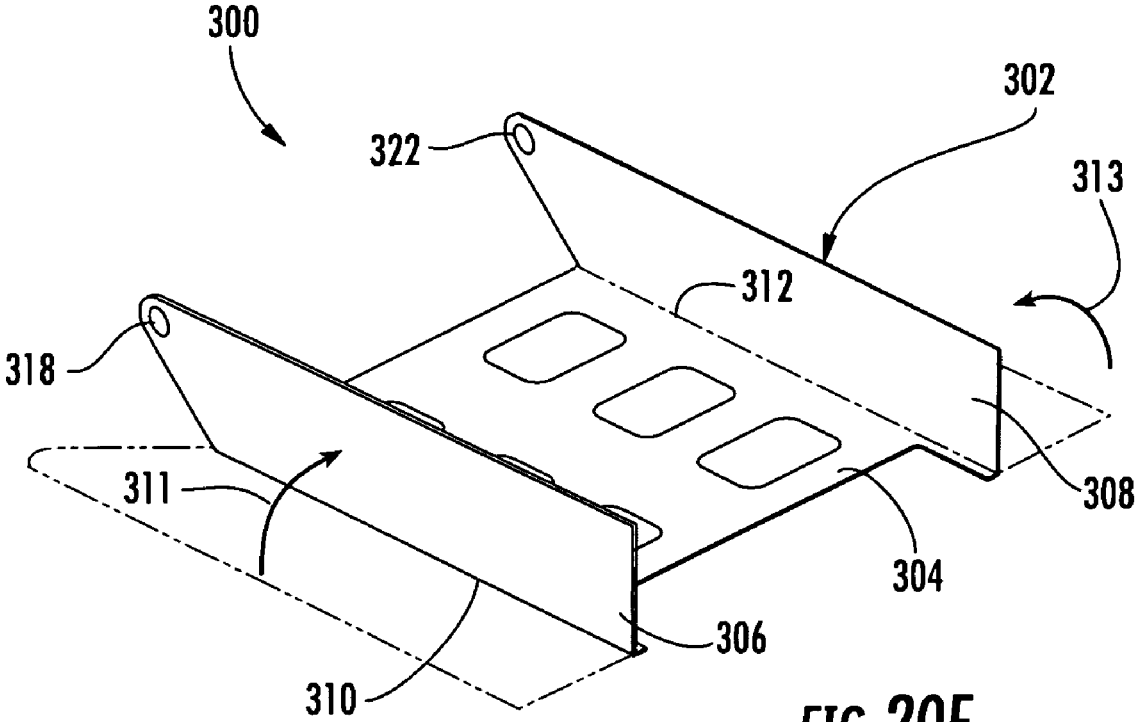

In another embodiment, with reference to FIG. 20A, continuous piece 302 of metal terminates at fold lines 314 and 316 such that wing areas 306 and 308 exhibit the configuration illustrated in FIG. 20E. In this embodiment, support structure 300 is formed from continuous piece 302 of metal by folding wing areas 306 and 308 at respective fold lines 310 and 312 with respect to generally rectangular area 304 as illustrated by arrows 311 and 313 respectively in FIG. 20F. The function, configuration, and construction of support structure 300 in this embodiment is otherwise identical to that described above.

In additional embodiments, support structure 300 illustrated in FIGS. 20A through 20D may be used as support structure 30 (FIG. 2), support structure 190 (FIG. 13), and/or support structure 244 (FIG. 17). In such embodiments, structures 328 are pivotally attached to top support 24 (FIG. 2), support platform 188 (FIG. 13), or to support platform 242 (FIG. 17). Ramps 192 (FIG. 13) and 246 (FIG. 17) may be affixed to support structure 300 by welding, rivets, or any other suitable attachment means, such as bushings or fasteners.

Generally rectangular area 304 of support structure 300 defines a number of generally rectangular apertures as illustrated in FIGS. 20A through 20F. Inclusion of such apertures in area 304 reduces the weight of support structure 300. It should be understood, however, that such apertures are not essential to the construction, configuration, and operation of support structure 300. The present invention therefore contemplates a support structure similar to support structure 300 but lacking inclusion of such apertures.

It can thus be seen that the present invention provides various structures for the construction of a gangway. While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

The following is claimed:

1. A method for manufacturing a gangway, wherein the gangway comprises a plurality of tread supports and an underbody, said method comprising the steps of:

providing a first tread support of the plurality of tread supports from a first continuous piece of metal such that the first continuous piece of metal defines a left flange area and a right flange area, connected to a tread area, wherein the left flange area and the right flange area are opposite one another with respect to the tread area, the left flange area and the tread area define a first fold line, and the right flange area and the tread area define a second fold line;

folding the left flange area with respect to the tread area at the first fold line;

folding the right flange area with respect to the tread area at the second fold line;

providing the underbody from a second continuous piece of metal, wherein the second continuous piece of metal defines a first side area opposite a second side area with respect to a middle area located between the first and second side areas, the first side area and middle area define a first side fold line, and the second side area and middle area define a second side fold line;

folding the first side area with respect to the middle area at the first side fold line so that the first side area becomes a left support of the underbody;

folding the second side area with respect to the middle area at the second side fold line so that the second side area becomes a right support of the underbody; and connecting one side of the first tread support to the left support and an opposite side of the first tread support to the right support.

2. The method of claim 1 wherein the step of providing a first tread support comprises the first continuous piece of metal defining a front area and a back area connected to the tread area, wherein the front area and the back area are opposite one another with respect to the tread area, the front area and the tread area define a third fold line, and the back area and the tread area define a fourth fold line; and wherein the method further comprises the steps of:

folding the front area with respect to the tread area at the third fold line; and folding the back area with respect to the tread area at the fourth fold line.

3. The method of claim 2 further comprising the steps of:

providing the first continuous piece of metal being configured such that the left flange area defines a first left flange portion and a second left flange portion, wherein the first left flange portion and the second left flange portion define a left flange fold line;

providing the first continuous piece of metal being configured such that the right flange area defines a first right flange portion and a second right flange portion, wherein the first right flange portion and the second right flange portion define a right flange fold line;

folding the second left flange portion with respect to the first left flange portion at the left flange fold line such that a portion of the first left flange portion comes in contact with a portion of the second left flange portion; and folding the second right flange portion with respect to the first right flange portion at the right flange fold line such that a portion of the first right flange portion comes in contact with a portion of the second right flange portion.

4. The method of claim 3 further comprising the steps of:

providing the first continuous piece of metal being configured such that the second left flange portion define at least one left tab and the second right flange portion define at least one right tab;

connecting a left handrail to the left support;

connecting a right handrail to the right support;

connecting the at least one left tab to the left handrail; and connecting the at least one right tab to the right handrail.

5. The method of claim 1 further comprising the steps of:

forming a second tread support of the plurality of tread supports from a third continuous piece of metal; and connecting the second tread support to the left support and to the right support.

6. The method of claim 5 wherein the step of forming the second tread support from the third continuous piece of metal further comprises:

defining an intermediary tread area and an intermediary front area from the third continuous piece of metal, wherein the intermediary tread area and the intermediary front area define an intermediary fold line; and folding the intermediary front area with respect to the intermediary tread area at the intermediary fold line;

whereby the second tread support results in a configuration different from the first tread support.

7. The method of claim 6 further comprising the steps of:

providing the third continuous piece of metal being configured such that the intermediary front area defines a left area and a right area opposite a center area, wherein the left area and the center area define a first intermediary front area fold line and the right area and the center area define a second intermediary front are fold line;

folding the left area with respect to the center area at the first intermediary front area fold line; and folding the right area with respect to the center area at the second intermediary front area fold line.

8. The method of claim 7 further comprising the steps of:

providing the third continuous piece of metal being configured such that the center area defines a first center area and a second center area, wherein the first center area is adjacent to the intermediary fold line and the second center area is opposite the intermediary fold line with respect to the first center area, the first center area and the second center area defining a center area fold line; and folding the second center area with respect to the first center area at the center area fold line.

9. The method of claim 8 further comprising the steps of:

providing the third continuous piece of metal being configured such that the intermediary tread area defines a first intermediary tread area and a second intermediary tread area, wherein the first intermediary tread area is adjacent to the intermediary fold line and the second intermediary tread area is opposite the intermediary fold line with respect to the first intermediary tread area, the first intermediary tread area and the second intermediary tread area defining an intermediary tread area fold line;

folding the second intermediary tread area with respect to the first intermediary tread area at the intermediary tread fold line.

10. The method of claim 5 for manufacturing a gangway, wherein the gangway further comprises a third tread support of the plurality of tread supports, said method further comprising the steps of:

forming the third tread support from a fourth continuous piece of metal; and connecting the third tread support to the left support and to the right support.

11. The method of claim 1 further comprising the steps of:

providing the second continuous piece of metal being configured such that the first side area defines a first left wing area and a second left wing area, wherein the second left wing area is opposite the first side fold line with respect to the first left wing area, and the first left wing area and the second left wing area define a left wing area fold line;

providing the second continuous piece of metal being configured such that the second side area defines a first right wing area and a second right wing area, wherein the second right wing area is opposite the second side fold line with respect to the first right wing area, and the first right wing area and the second right wing area define a right wing area fold line;

folding the second left wing area with respect to the first left wing area at the left wing area fold line to form the left support; and folding the second right wing area with respect to the first right wing area at the right wing area fold line to form the right support.

12. A method for manufacturing a gangway, wherein the gangway comprises at least one tread support and an underbody having a left support and a right support, said method comprising the steps of:

providing the underbody from a continuous piece of metal such that the continuous piece of metal defines a left wing area and a right wing area connected to a center area, wherein the left wing area is opposite the right wing area with respect to the center area, the left wing area and the center area define a left wing fold line, and the right wing area and the center area define a right wing fold line;

folding the left wing area with respect to the center area at the left wing fold line to form the left support;

folding the right wing area with respect to the center area at the right wing fold line to form the right support; and pivotally connecting one side of the at least one tread support to the left support of the underbody and an opposite side of the at least one tread support to the right support of the underbody.

13. The method of claim 12 further comprising the steps of:

the continuous piece of metal being configured such that the left wing area defines a first left wing area and a second left wing area, wherein the second left wing area is opposite the left wing fold line with respect to the first left wing area and the first left wing area and the second left wing area define a left wing area fold line;

the continuous piece of metal being configured such that the right wing area defines a first right wing area and a second right wing area, wherein the second right wing area is opposite the right wing fold line with respect to the first right wing area and the first right wing area and the second right wing area define a right wing area fold line;

folding the second left wing area with respect to the first left wing area at the left wing area fold line to form the left support; and folding the second right wing area with respect to the first right wing area at the right wing area fold line to form the right support.

14. A method for manufacturing a gangway, wherein the gangway comprises a ramp and an underbody having a left support and a right support, said method comprising the steps of:

providing a first continuous piece of metal such that the first continuous piece of metal defines a left area and a right area connected to a tread area such that the left area is opposite the right area with respect to the tread area, wherein the left area and the tread area define a first fold line and the right area and the tread area define a second fold line;

folding the left area with respect to the tread area at the first fold line;

folding the right area with respect to the tread area at the first fold line;

forming the ramp from the first continuous piece of metal such that the left area defines a first left area and a second left area such that the first left area is adjacent the first fold line and the second left area is opposite the first fold line with respect to the first left area, wherein the first left area defines a first left hole, the second left area defines a second left hole, and the first left area and the second left area define a third fold line;

folding the second left area with respect to the first left area at the third fold line such that the first left hole aligns with the second left hole;

forming the ramp from the first continuous piece of metal such that the right area defines a first right area and a second right area such that the first right area is adjacent the second fold line and the second right area is opposite the second fold line with respect to the first right area, wherein the first right area defines a first right hole, the second right area defines a second right hole, and the first right area and the second right area define a fourth fold line;

folding the second right area with respect to the first right area at the fourth fold line such that the first right hole aligns with the second right hole; and connecting the ramp to the left support and to the right support.

15. The method of claim 14 wherein the step of connecting the ramp to the left support and to the right support further comprises:

passing a first mechanism through the first and second left holes and connecting the first mechanism to the left support; and passing a second mechanism through the first and second right holes and connecting the second mechanism to the right support.

16. The method of claim 15 wherein the first and second mechanisms are comprised of a bar.

17. The method of claim 14 further comprising the steps of:

folding the second left area with respect to the first left area at the third fold line such that the second left area extends beyond the first left area to create a first foot rail; and folding the second right area with respect to the first right area at the fourth fold line such that the second right area extends beyond the first right area to create a second foot rail.

18. The method of claim 14 further comprising the step of forming the underbody from a second continuous piece of metal.

19. The method of claim 18 wherein the step of forming the underbody from the second continuous piece of metal further comprises:

defining a left wing area and a right wing area connected to a center area from the second continuous piece of metal, wherein the left wing area is opposite the right wing area with respect to the center area, the left wing area and the center area define a left wing fold line, and the right wing area and the center area define a right wing fold line;

folding the left wing area with respect to the center area at the left wing fold line; and folding the right wing area with respect to the center area at the right wing fold line.

20. The method of claim 19 further comprising the steps of:

forming the underbody from the second continuous piece of metal such that the left wing area defines a first left wing area and a second left wing area, wherein the second left wing area is opposite the left wing fold line with respect to the first left wing area and the first left wing area and the second left wing area define a left wing area fold line;

forming the underbody from the second continuous piece of metal such that the right wing area defines a first right wing area and a second right wing area, wherein the second right wing area is opposite the right wing fold line with respect to the first right wing area and the first right wing area and the second right wing area define a right wing area fold line;

folding the second left wing area with respect to the first left wing area at the left wing area fold line to form the left support; and folding the second right wing area with respect to the first right wing area at the right wing area fold line to form the right support.

21. The method of claim 14 for manufacturing a gangway, wherein the gangway further comprises a telescoping ramp, said method further comprising the step of forming the telescoping ramp from a second continuous piece of metal.

22. The method of claim 21 wherein the step of forming the telescoping ramp from a second continuous piece of metal further comprises:

defining a telescoping left area and a telescoping right area connected to a telescoping tread area from the second continuous piece of metal, such that the telescoping left area is opposite the telescoping right area with respect to the telescoping tread area, the telescoping left area and the telescoping tread area define a first telescoping fold line, and the telescoping right area and the telescoping tread area define a second telescoping fold line;

folding the telescoping left area with respect to the telescoping tread area at the first telescoping fold line; and folding the telescoping right area with respect to the telescoping tread area at the second telescoping fold line.

23. The method of claim 21 further comprising the step of configuring the ramp to define a storage area underneath the ramp to store the telescoping ramp when the telescoping ramp is in the non-extended position.

24. A method for manufacturing a gangway, wherein the gangway comprises an underbody and at least one tread support connected to the underbody, said method comprising the steps of:

providing a first continuous piece of metal configured to be made into the underbody;

folding the first continuous piece of metal into the underbody so that the first continuous piece of metal defines a left support of the underbody and a right support of the underbody opposite one another with respect to and interconnected by a middle portion of the underbody, wherein the left and right supports are relatively parallel to one another and perpendicular to the middle portion;

providing a second continuous piece of metal configured to be made into the at least one support;

folding the second continuous piece of metal into the at least one support; and connecting one side of the at least one support to the left support of the underbody and an opposite side of the at least one support to the right support of the underbody.

25. The method of claim 24 for manufacturing a gangway, wherein the gangway further comprises a telescoping ramp, said method further comprising:

providing a third continuous piece of metal configured to be made into the telescoping ramp;

folding the third continuous piece of metal into the telescoping ramp; and connecting the telescoping ramp to the at least one support.

26. The method of claim 24 for manufacturing a gangway, wherein the gangway further comprises a base support, said method further comprising:

providing a third continuous piece of metal configured to be made into the base support;

folding the third continuous piece of metal into the base support; and connecting the base support to the underbody.

27. The method of claim 24 for manufacturing a gangway, wherein the gangway further comprises a top support, said method further comprising:

providing a third continuous piece of metal configured to be made into the top support;

folding the third continuous piece of metal into the top support;

connecting the top support to a support structure; and connecting the underbody to the support structure.

28. A gangway providing a path of travel comprising:

a first continuous piece of metal forming an underbody; and a second continuous piece of metal forming a tread support, wherein two opposite sides of the tread support are connected to the underbody, wherein the underbody is configured to connect to a structure in a manner that allows the underbody to rotate in a vertical manner with respect to the path of travel about an axis defined by the connection of the underbody to the structure and allows the tread support to rotate in the vertical manner with the underbody.

29. A gangway comprising:

a first continuous piece of metal forming an underbody, the first continuous piece of metal having a planar center portion and first and second flange portions located on respective sides of the planar center portion, the first and second flange portions extending integrally from the planar portion and being defined by first and second respective underbody fold lines; and a support, wherein one side of the support is connected to the first flange of the first continuous piece of metal and an opposite side of the support is connected to the second flange of the first continuous piece of metal.

30. The gangway of claim 29 wherein the support is rotatably connected to the underbody.

31. The gangway of claim 29 wherein the support is affixed to a support structure; and the underbody is rotatably connected to the support.

32. The gangway of claim 29 wherein the support is formed of a second continuous piece of metal, the second continuous piece of metal having a planar middle portion and first and second side portions located on respective left and right sides of the planar middle portion, the first and second side portions extending integrally from the planar middle portion and being defined by first and second respective support fold lines.

33. The gangway of claim 32 wherein the second continuous piece of metal having third and fourth side portions located on respective fore and aft sides of the planar middle portion, the third and fourth side portions extending integrally from the planar middle portion and being defined by third and fourth respective support fold lines.

34. The gangway of claim 33 wherein:

the third side portion having a third side end portion extending integrally from the third side portion and being defined by a fifth support fold line; and the fourth side portion having a fourth side end portion extending integrally from the third side portion and being defined by a sixth support fold line.

35. A gangway comprising:

an underbody formed by the process of:

providing a first continuous piece of metal configured to be made into the underbody;

folding the first continuous piece of metal into the underbody, thereby defining a left side and a right side of the underbody separated by a middle section of the underbody; and at least one support, wherein one side of the at least one support is connected to the left side of the underbody and an opposite side of the at least one support is connected to the right side of the underbody.

36. The gangway of claim 34 wherein:

the at least one support is formed by the process of:

providing a second continuous piece of metal configured to be made into the at least one support; and folding the second continuous piece of metal into the at least one support.

37. The gangway of claim 36 further comprising:

a base support connected to the underbody and formed by the process of:

providing a third continuous piece of metal configured to be made into the base support; and folding the third continuous piece of metal into the base support.

* * * * *